US010650626B2

(12) United States Patent
Shadid et al.

(10) Patent No.: US 10,650,626 B2
(45) Date of Patent: May 12, 2020

(54) SMART BUILDING SYSTEM FOR INTEGRATING AND AUTOMATING PROPERTY MANAGEMENT AND RESIDENT SERVICES IN MULTI-DWELLING UNIT BUILDINGS

(71) Applicant: Urban SKY, LLC, Bensenville, IL (US)

(72) Inventors: Silas Shadid, Bensenville, IL (US); Dann J. Farquhar, Elgin, IL (US)

(73) Assignee: Urban SKY, LLC, Bensenville, IL (US)

( * ) Notice: Subject to any disclaimer, the term of this patent is extended or adjusted under 35 U.S.C. 154(b) by 0 days.

(21) Appl. No.: 15/088,903

(22) Filed: Apr. 1, 2016

(65) Prior Publication Data

US 2016/0294572 A1 Oct. 6, 2016

Related U.S. Application Data

(60) Provisional application No. 62/141,652, filed on Apr. 1, 2015.

(51) Int. Cl.
*G07C 9/00* (2020.01)

(52) U.S. Cl.
CPC ..... *G07C 9/00182* (2013.01); *G07C 9/00571* (2013.01); *G07C 9/00904* (2013.01); *G07C 2009/00214* (2013.01); *G07C 2009/00222* (2013.01); *G07C 2009/00984* (2013.01)

(58) Field of Classification Search
CPC ..... H04L 12/28; H04L 12/931; G07C 9/00; G06F 15/177; G01M 99/00; G01D 18/00; F25B 49/00; G01K 13/00
USPC ..... 340/4.34; 714/27; 709/221; 62/127
See application file for complete search history.

(56) References Cited

U.S. PATENT DOCUMENTS 6,363,053 B1 * 3/2002 Schuster ..... H04L 41/5003 370/230
6,453,687 B2 * 9/2002 Sharood ..... F25D 29/00 62/127
6,625,648 B1 * 9/2003 Schwaller ..... H04L 41/0213 370/230
6,934,862 B2 * 8/2005 Sharood ..... G06Q 30/0235 713/300
7,143,048 B1 11/2006 Ruben et al.
(Continued)

OTHER PUBLICATIONS

RealPage, Inc., <http://www.realpage.com/> webpage available as early as Dec. 27, 1996.

(Continued)

*Primary Examiner* — Nam V Nguyen
(74) *Attorney, Agent, or Firm* — The Watson IP Group, PLC; Jovan N. Jovanovic

(57) ABSTRACT

A method for converting a legacy building into a smart building. The method including calculating a distance between a first connection point and a second connection point; creating a cable having a first length based on the distance between the first connection point and the second connection point; installing a demarcation point; installing a plurality of systems; connecting the demarcation point and a system using the cable, to create a smart building system; connecting the smart building system to a portal; and testing the connection of the smart building system to the portal.

4 Claims, 17 Drawing Sheets

(56) References Cited

U.S. PATENT DOCUMENTS 7,295,655 B2 * 11/2007 Harrison ..... H04M 3/08 379/1.01
7,831,732 B1 * 11/2010 Zilist ..... G06Q 10/00 709/217
8,259,907 B2 * 9/2012 Irenze ..... H04M 1/24 379/21
8,271,321 B1 9/2012 Kestenbaum
8,600,556 B2 * 12/2013 Nesler ..... G01R 21/133 370/395.52
8,630,741 B1 * 1/2014 Matsuoka ..... H04L 12/2829 700/276
9,671,768 B2 * 6/2017 Lo ..... G05B 15/02
9,753,455 B2 * 9/2017 Drees ..... G05B 23/0229
2002/0000092 A1 * 1/2002 Sharood ..... F25D 29/00 62/127
2003/0053603 A1 * 3/2003 Vejlgaard ..... H04L 12/66 379/52
2003/0139134 A1 * 7/2003 Bailey ..... H04L 12/66 455/3.01
2007/0038563 A1 2/2007 Ryzerski
2009/0003221 A1 * 1/2009 Burns ..... H04L 12/2697 370/241
2009/0240565 A1 9/2009 Calonge
2011/0071929 A1 3/2011 Morrison
2011/0158649 A1 6/2011 Hari
2012/0233300 A1 * 9/2012 Marmolejo-Meillon ..... G06F 15/781 709/221
2012/0307982 A1 * 12/2012 Faulkner ..... H04M 3/305 379/27.01
2014/0115393 A1 * 4/2014 Kuwahara ..... G06F 11/273 714/27
2015/0088312 A1 * 3/2015 Lo ..... G05B 15/02 700/275
2015/0106061 A1 * 4/2015 Yang ..... G08C 17/00 702/188
2015/0161020 A1 * 6/2015 Matsuoka ..... G01F 11/00 702/189
2015/0213710 A1 * 7/2015 Kinne ..... G08C 17/02 340/12.5

OTHER PUBLICATIONS

CCI, Card Concepts, Inc., "LaundryCard" <http://www.laundrycard.com/> webpage available as early as Jul. 20, 2001.
Smart Building Services LLC, <http://www.sbsmi.com/> webpage available as early as Jul. 28, 2003.
Community Secure, <http://www.communitysecure.com/security.html> webpage available as early as May 22, 2012.

* cited by examiner

800

ACME MANAGEMENT

CONTACT#: (123) 456-7890 OR QUICK DIAL 311*

123 ABC STREET

| UNIT | NAME | CALL |
|---|---|---|
| 1A | A HINES | 101* |
| 1B | RPATTERSN | 102* |
| 1B | TPATTERSN | 102* |
| 1C | J SWINGLER | 103* |
| 1D | L BOYD | 104* |
| 1E | S HARDY | 105* |
| 1F | T BURNETT | 106* |
| 1G | G WADE | 107* |
| 1H | C AUSTIN | 108* |
| 1J | S LEWIS | 109* |
| 1J | A CALDWELL | 109* |
| 1K | D RILEY | 110* |
| 2A | I BECK | 201* |
| 2B | F RUSHING | 202* |
| 2C | L STEWART | 203* |
| 2D | A HINES | 204* |
| 2E | B MITCHELL | 205* |
| 2E | D STORBALL | 205* |
| 2E | T STORBALL | 205* |

| UNIT | NAME | CALL |
|---|---|---|
| 2F | F LEFLORE | 206* |
| 2G | J MOORE | 207* |
| 2H | K DENNIS | 208* |
| 2J | J WILLIAMS | 209* |
| 2K | T GUNN | 210* |
| 3A | S DIGGS | 301* |
| 3B | T ANDERSN | 302* |
| 3C | G HUBBARD | 303* |
| 3E | T RUSSELL | 305* |
| 3F | S JOHNSON | 306* |
| 3G | S STANLEY | 307* |
| 3H | C HAMPTN | 308* |
| 3J | R FLETCHER | 309* |
| 3J | K JACKSON | 309* |
| GB | A WORTHM | 002* |
| GC | C WADE | 003* |
| GD | D THOMPSN | 004* |
| GE | P BRADLEY | 005* |

FIG. 8

SMART BUILDING SYSTEM FOR INTEGRATING AND AUTOMATING PROPERTY MANAGEMENT AND RESIDENT SERVICES IN MULTI-DWELLING UNIT BUILDINGS

RELATED APPLICATIONS

The present application claims priority to U.S. Provisional Patent Application No. 62/141,652, filed Apr. 1, 2015, the entire contents of which are hereby incorporated.

BACKGROUND

Embodiments of the invention relate to the field of automated building and property management.

SUMMARY

Traditional multi-dwelling unit buildings include a plurality of systems, including entrance systems, laundry systems, security systems, television/internet/telephone service systems, as well as other systems. Typically these systems are legacy systems that are stand-alone or separate from each other.

For example, traditionally, entrance systems are a stand-alone system that may only be accessed when a resident is in the presence of the system. For example, if a visitor comes to visit a resident, the resident may have to travel to the location of the door to allow access to the visitor or the resident may need to push a button in their unit to unlock the door and allow the visitor entrance. However, if the resident is not in the building, the resident cannot allow access to the visitor. For example, if a visitor needs to drop something off in the resident's unit and the resident is on vacation, the resident cannot grant access to the visitor unless the resident gave a key or other means of entrance, such as a fob, to the visitor before the resident left on vacation. Additionally, interior doors in a building may require a key or other means of entrance, such as a fob. This type of entrance system requires a resident to carry around a key or other means of entrance which may easily get lost, misplaced, or taken by someone else.

Furthermore, in multi-dwelling units, residents traditionally pay for appliances, such as a laundry wash machine and dryer, by using physical currency (e.g., coins). If residents do not have the correct amount of change or coins, then they cannot use the appliance. Additionally, appliances can often be in use when a resident wants to use the appliance, so the resident must make numerous trips to check when the appliance is not in use during busy times. Another problem with traditional appliance use is that a resident may not want to use the appliance when they are physically near it. For example, a resident may have time to put laundry in a laundry machine, but they do not have time to put the laundry in the dryer until much later in the day, and therefore do not want the appliance to start until closer to the time that they can attend to it.

Also, residents in multi-dwelling units traditionally control their own services, such as television, internet, and or telephone. This may result in numerous problems. For example, if each resident has their own service, multiple satellite dishes or other service hardware are installed for every unit leading to redundant satellite dishes or service hardware on or throughout the building. In other situations, one system provides services to the residents and is regulated by the owner or manager. If a resident does not pay a bill for a service, the owner or manager has to manually regulate and turn off a resident's access to the service.

Thus, when the systems in a traditional legacy multi-dwelling unit must be separately accessed and managed, it requires a great amount of time and cost for residential users, owners, and managers. Additionally, if any new smart technology is added to the building, it may not communicate with the legacy system and is difficult to install in preexisting buildings due to the large amount of technology that needs to be added to the building. In addition, the smart building technology is normally generic smart technology that may not be properly configured to work in a preexisting building. For example, cable lengths may not be long enough to adapt to the building. This creates a tedious and confusing installation process that takes a large amount of time and cost.

Embodiments of the present invention overcome these issues by converting pre-existing legacy systems into smart building systems. Embodiments can easily and efficiently be installed through the use of preconfigured parts that are custom made to fit the particular building in which they are going to be installed. In one embodiment, the invention manipulates the current signals of the existing legacy systems by converting the existing legacy system signals into digital signals. Through the digital signals, the existing legacy systems may be connected to a central portal where all of the systems may be accessed, controlled, and analyzed. In addition to pre-existing legacy systems, new smart building systems may also be added and accessed quickly and easily at the portal. Some of these systems may solve additional problems of multi-dwelling unit buildings.

Additionally, embodiments of the present invention overcome these issues by implementing remote-controlled devices, such as but not limited to, an intelligent opening system, an appliance control device, and a multi-port coaxial cable switching device. In some embodiments, the intelligent opening system allows for opening and closing of interior and exterior doors through the portal. By using the portal, residents can easily open and close doors from remote locations. For example, a resident may open a door for a visitor when the resident is on vacation by accessing the portal using a portable electronic device, such as a smart phone or tablet computer. A resident may also access the portal using a portable electronic device to open doors when they are walking around in the building, instead of having to carry around a key or other means of entrance.

In some embodiments, the appliance control device is communicatively coupled to the building system. The appliance control device allows a resident to use a fob to pay for laundry. The resident may add money to the fob using the portal. Additionally, the appliance control device allows a user to check, via the portal, if an appliance is being used. The appliance control device also allows a resident to designate the time that they want an appliance to start.

In some embodiments, the multi-port coaxial cable switching device is connected to the portal. The multi-port coaxial switching device automatically connects or disconnects a residential unit to or from a service based on the resident's payment of a bill so that an owner or manager does not have to manually perform these tasks.

Both the legacy systems and the new systems, such as the intelligent opening system, the appliance control device, and the multi-port coaxial switching device may be managed and accessed through the portal. This portal combines property management, amenities, utilities, and other aspects of multi-dwelling units that may be instantly accessed and controlled by owners, managers, and/or residents. Utilizing this smart building system lowers operating costs for multi-dwelling units and creates new sources of revenue for building owners by providing energy conservation, improved safety systems, improved accounting and documentation, and owner and resident connectivity.

Embodiments of the invention provide systems and methods to control and monitor systems and devices that provide property management tools and services for building owners, managers, and residents of multi-dwelling unit (MDU) buildings. The system is configured to control and monitor systems and devices that provide internet service, telephone service, television service, building security, utility management, and resident amenities. The system includes an online portal that provides building owners, managers, and residents with property management tools, legal management tools, payment gateways, facilities management tools, utility management tools, risk management tools, and social or community media services.

Another embodiment of the invention provides a method for converting a legacy building into a smart building. The method including calculating a distance between a first connection point and a second connection point; creating a cable having a first length based on the distance between the first connection point and the second connection point; installing a demarcation point; installing a plurality of systems; connecting the demarcation point and a system using the cable, to create a smart building system; connecting the smart building system to a portal; and testing the connection of the smart building system to the portal.

Another embodiment of the invention provides a system for managing the provisioning of a service. The system includes a multi-port coaxial cable switching device that includes a power supply, an electrical backplane for transmitting control signals, and a plurality of coaxial cable switch modules. Each coaxial cable switch module has at least one input port coupled to a source of a service, a connector coupled to the electrical backplane, an output port coupled to a residential unit, and a switch capable of selectively connecting the input port to the output port. The system also includes a controller with an electronic processor and a memory. The controller is configured to receive a status of one of the plurality of coaxial cable switch modules from the multi-port coaxial cable switching device and transmit, using the electrical backplane, a control signal to the switch of one of the plurality of coaxial cable switch modules from the multi-port coaxial cable switching device.

Another embodiment of the invention provides a system for managing the use of an appliance. The system includes an appliance control device with an appliance activator for activating an appliance cycle, a sensor for detecting the status of an appliance, a user interface for receiving a user request and a payment, and a controller including an electronic processor and a memory, The controller is configured to receive a request for activation of the appliance from the appliance control device, determine if an amenities balance is above a threshold, and transmit an activation signal to the appliance control if the amenities balance is above the threshold.

Another embodiment of the invention provides a system for managing a property including a plurality of units. The system includes an entrance PCB, a digital intercom, and a controller. The entrance PCB includes a power supply, a user interface, a door locking mechanism, a sensor to determine the status of an entrance. The digital intercom converts a legacy property into a smart building property. The digital intercom includes a power supply, an input for receiving a legacy control signal, an analog to digital converter, and an output for sending digital signals. The controller includes an electronic processor and a memory, the controller is configured to transmit a control signal to a door locking mechanism, and convert a legacy signal into a digital smart building signal.

Other aspects of the invention will become apparent by consideration of the detailed description and accompanying drawings.

BRIEF DESCRIPTION OF THE DRAWINGS

FIG. 8 is a names display panel of the exterior intelligent opening system of FIG. 4 according to some embodiments.

DETAILED DESCRIPTION

Figure 1:
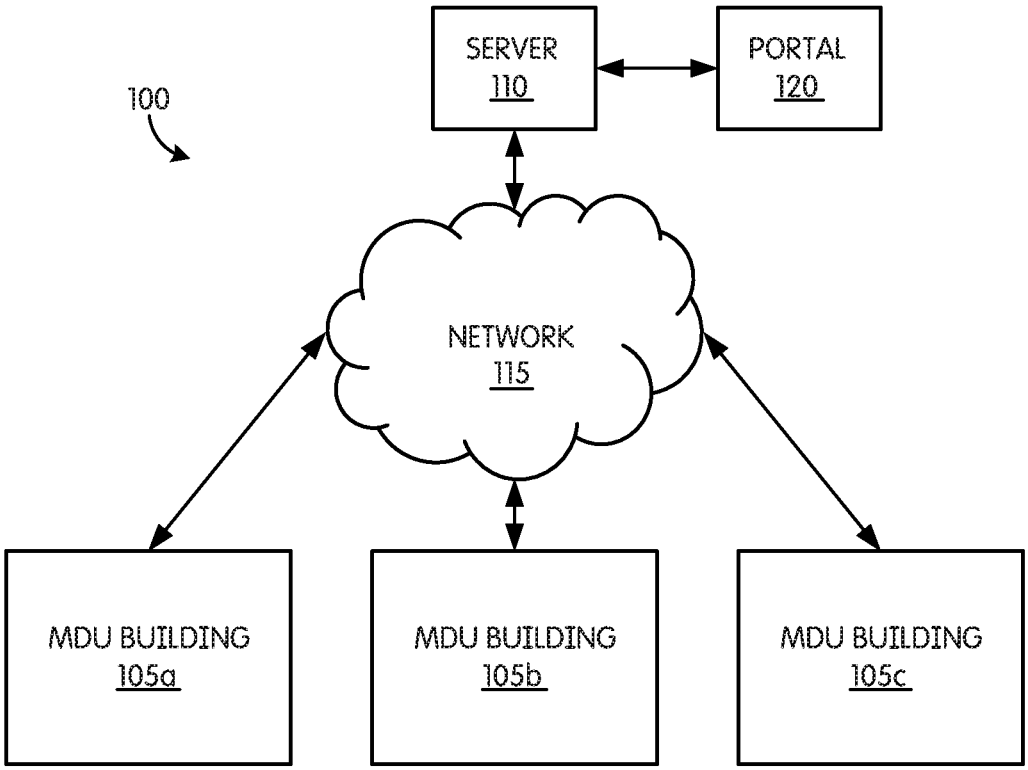
FIG. 1 is a block diagram of a smart building system according to some embodiments.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. For example, "control units" and "controllers" described in the specification may include components, such as one or more processors, one or more memory modules including non-transitory computer-readable medium, one or more input/output interfaces, and various connections (e.g., a system bus) connecting the components.

It should also be noted that some embodiments of the invention include networked computers or servers. Each of the computers or servers include, among other things, a processor (e.g., a microprocessor or another suitable programmable device), a memory (i.e., a computer-readable storage medium), and an input/output interface. The processor, the memory, and the input/output interface, as well as the other various modules are connected by one or more control or data buses. The use of control and data buses for the interconnection between and communication among the various modules and components would be known to a person skilled in the art in view of the invention described herein. Examples of computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. The memory includes a program storage area and a data storage area. The processor is connected to the memory and executes computer readable code ("software") stored in a RAM of the memory (e.g., during execution), a ROM of the memory (e.g., on a generally permanent basis), or another non-transitory computer readable medium. Software included for the processes and methods for the systems described herein may be stored in the memory. The software may include firmware, one or more applications, program data, databases, filters, rules, one or more program modules, and other executable instructions. The processor is configured to retrieve from the memory and execute, among other things, instructions related to the processes and methods described herein. The processor may be comprised of one or more generic or specialized processors (or "processing devices") such as microprocessors, digital signal processors, customized processors and field programmable gate arrays (FPGAs).

As illustrated in FIG. 1, one exemplary embodiment of the invention provides a smart building system 100 configured to control and monitor systems and/or devices within a multi-dwelling unit (MDU) building (e.g., MDU buildings 105*a*-105*c*). Although illustrated as including three MDU buildings 105*a*-105*c*, the smart building system 100 may be configured to control and monitor more or less MDU buildings. The smart building system 100 includes a server 110 that may be located remotely from the MDU buildings 105*a*-105*c*. In other embodiments, the server 110 may be located within one of the MDU buildings 105*a*-105*c*.

The server 110 may be communicatively coupled to each MDU building 105*a*-105*c* through a network 115. In some embodiments, the network is, for example, a wide area network ("WAN") (e.g., a TCP/IP based network, a cellular network, such as, for example, a Global System for Mobile Communications ["GSM"] network, a General Packet Radio Service ["GPRS"] network, a Code Division Multiple Access ["CDMA"] network, an Evolution-Data Optimized ["EV-DO"] network, an Enhanced Data Rates for GSM Evolution ["EDGE"] network, a 3GSM network, a 4GSM network, a Digital Enhanced Cordless Telecommunications ["DECT"] network, a Digital AMPS ["IS-136/TDMA"] network, or an Integrated Digital Enhanced Network ["iDEN"] network, etc.).

In other embodiments, the network 115 is, for example, a local area network ("LAN"), a neighborhood area network ("NAN"), a home area network ("HAN"), or personal area network ("PAN") employing any of a variety of communications protocols, such as Wi-Fi, Bluetooth, ZigBee, etc. Communications through the network 115 can be protected using one or more encryption techniques, such as those techniques provided in the IEEE 802.1 standard for port-based network security, pre-shared key, Extensible Authentication Protocol ("EAP"), Wired Equivalency Privacy ("WEP"), Temporal Key Integrity Protocol ("TKIP"), Wi-Fi Protected Access ("WPA"), etc. The connections to and from the network 115 are, for example, wired connections, wireless connections, or a combination of wireless and wired connections.

In some embodiments, the smart building system 100 may further include a local server located in each MDU building 105*a*-105*c*. In such an embodiment, each local server is communicatively coupled to the server 110 through network 115.

The server 110 may further be communicatively coupled to a portal 120. In some embodiments, the server 110 may be communicatively coupled to the portal 120 via the internet. In other embodiments, the server 110 may be communicatively coupled to the portal 120 via a WAN or LAN, as discussed above.

The portal 120 may be configured to provide a user with information concerning the smart building system 100 and individual MDU buildings 105*a*-105*c*. Furthermore, the portal 120 may be configured to receive user input from the user. The portal 120 is a central location for information and communication regarding the smart building system 100, individual MDU buildings 105*a*-105*c*, and people (e.g., residents of MDU buildings 105*a*-105*c*) associated with the smart building system 100. In some embodiments, the portal 120 includes information about intelligent opening systems, laundry systems, security systems, television/internet/telephone service systems, as well as other systems. A user may access and interact with the portal 120 to receive and provide information regarding the individual MDU buildings 105*a*-105*c*. Users may include the system administrators, building owners, building managers, service providers, brokers, agents, and residents. In some embodiments, such access and interaction to the portal 120 may be provided by a user-interface 200 (FIG. 2).

Figure 2:
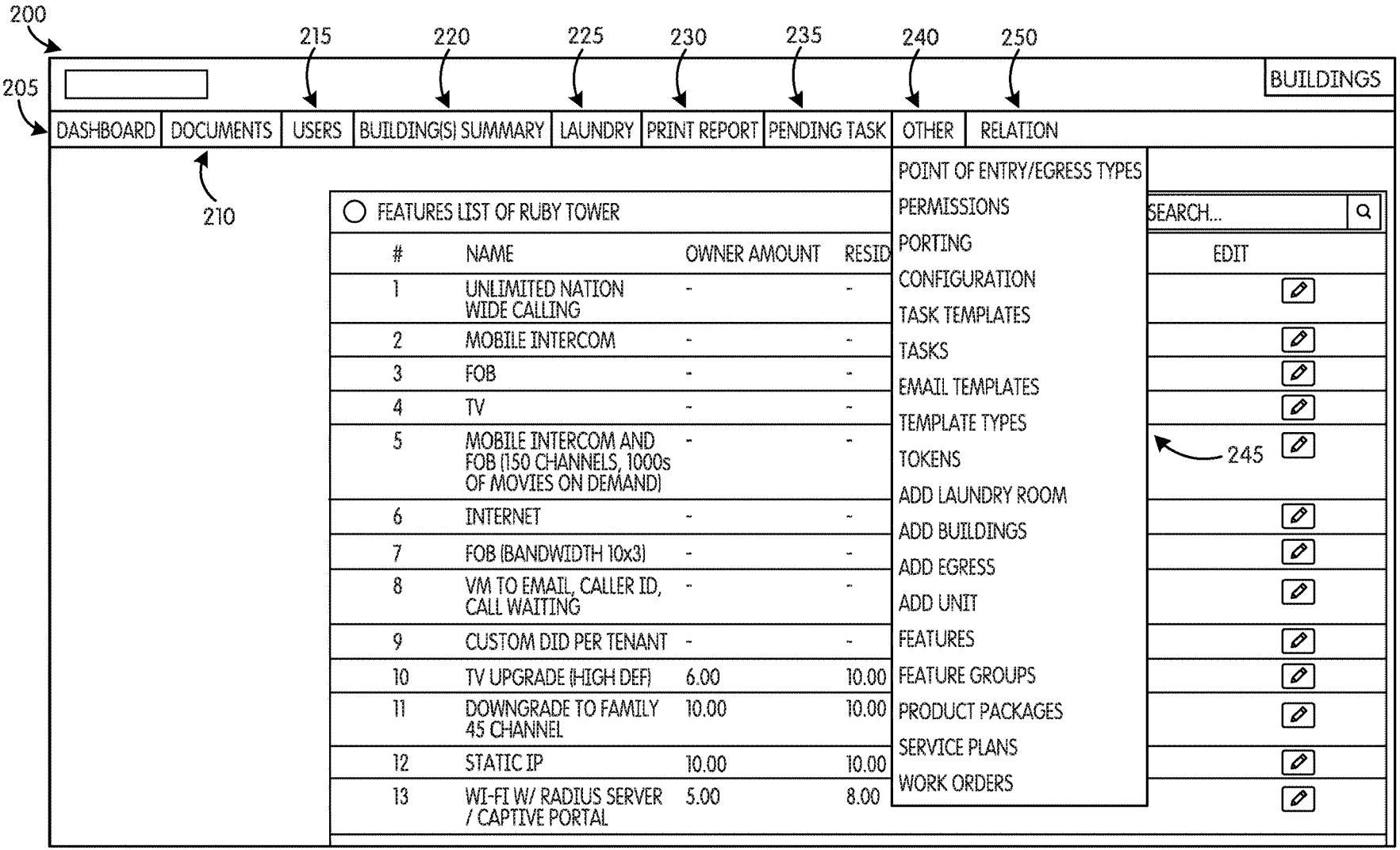
FIG. 2 is a user interface of the portal of FIG. 1 in some embodiments.

FIG. 2 illustrates a user-interface 200 configured to provide access to the portal 120, according to some embodiments. Other embodiments may have different layouts, tabs, options, and other settings. The user-interface 200 may be accessed through a smart phone, tablet, computer, or other computing device. In the embodiment illustrated in FIG. 2, the upper dashboard 205 allows a user to select a documents tab 210, users tab 215, a building(s) summary tab 220, a laundry tab 225, a print report tab 230, a pending task tab 235, an other tab 240, and/or a relation tab 250. In other embodiments, more, less, or different tabs may be displayed containing more, less, or different functionality.

In some embodiments, the documents tab 210 allows a user to find, create, send, and/or store documentation, such as but not limited to, leases, instructions, templates, or other documents. The users tab 215 shows the personnel (e.g., owner, security guard, residents) associated with an individual MDU building 105*a*-105*c*. In some embodiments, the users tab 215 includes contact information, role information, and other information, for each user of the smart building system 100. A user can add and update their own user information with the users tab 215. In some embodiments, this information may be displayed on the names display panel as described later. The building(s) summary tab 220 allows an owner or manager to add systems to an individual building such as a laundry system or intelligent opening system. A manager or owner can then analyze the use of systems and services with this tab such as the number of residents using the internet, a telephone, or a fob.

The laundry tab 225 includes a dashboard for viewing the status of a laundry unit. In some embodiments, the status of the laundry unit includes, but is not limited to, current usage, total usage, and maintenance information. The laundry tab 225 may also show data regarding individual appliances, such as the total usage of individual appliances and an amount of power an individual appliance uses. The laundry tab 225 may also allow an owner or manager to add and/or subtract individual appliances to the smart building system 100. The print report tab 230 may be configured to provide reports, such as resident lists, vacant units, and other data reports. The pending task tab 235 includes a list of tasks a user may need to complete (e.g., signing a lease by a certain date). In some embodiments, the pending task tab 235 includes a priority status for each task.

The other tab 240 includes numerous features as shown in the dropdown menu 245. In some embodiments, these features may include point of entry and egress types for monitoring and using building entry, permissions for setting user permissions when using the portal, porting for changing a service, configuration for adding high level building information such as a website, task templates, tasks, email templates, template types, and tokens. In some embodiments, a token may be an HID plastic FOB. In some embodiments, the token may be round. In other embodiments, the token may be a virtual FOB permanently embedded in a smart phone. With a virtual FOB permanently embedded in a smart phone a door may automatically open when a user walks up to it when Bluetooth is turned on. The features also may include add laundry room, add buildings for adding an additional MDU building (e.g., a building similar to MDU building 105*a*-105*c*), add egress, add unit, features which includes all of the building features such as television and internet services, feature groups, product packages for monitoring a tenant's use of a service, service plans, and work orders for submitting requests and checking the status of a maintenance work order. The relation tab 250 includes work order information, messages from users, and other notifications. When using the user-interface 200, an owner and/or manager may have permission to change and/or create information that a resident does not have permission to change or create. The portal 120 may be made to grant a plurality of users different levels of permission. For example, but not limited to, an owner may have a high-level of permission, a landlord may have a mid-level of permission, and a resident may have a low-level of permission.

The portal 120 may also include a number of modules that group information in the smart building system 100 and user-interface 200. The modules interoperate and can be accessed through the user-interface 200. In some embodiments, modules include a profile module, a building module, a services module, an agreements module, a work orders module, a messaging module, a notices module, an alerts module, and an orientation module. In some embodiments, these modules may be accessed by one or more of dropdown menus 245 of the dashboard 205.

The profile module may store the profiles of users of the smart building system 100. In some embodiments, the profile module may be accessed through the users tab 215 of the user-interface 200. Administrators may add, edit and delete all types of profiles. Building owners may edit their own profiles, and add, edit, and delete manager and resident profiles. Managers may edit their own profiles, and add, edit, and delete resident profiles. Service providers, brokers, agents, contractors, suppliers, and residents may edit their own profiles. Administrators access the profile module to configure it and set up all of the aspects of the profile module used by other modules and users. Building owners and managers access the portal 120 to add, change, or delete service providers, brokers, agents, contractors, suppliers, and residents. The portal 120 may be configured to allow residents to access the profile module to, among other things, pay for rent, amenities (such as laundry service), and cable, internet, and voice over internet protocol (VOIP) services.

The building module allows administrators to add one or more buildings to the smart building system 100. In some embodiments, the building module may be accessed by selecting "add buildings" from the dropdown menu 245 of the other tab 240 of the user-interface 200. Building owners, managers, service providers, brokers, agents, and residents may be linked to buildings.

The services module stores information related to cable service, telephone (e.g., VOIP) services, internet services, and/or security services (e.g., hosted online camera footage viewing). In some embodiments, the service module may be accessed by selecting "service plans" from the dropdown menu 245 of the other tab 240 of the user-interface 200. Building owners and managers may access the services module to control services for their residents.

The agreements module stores and manages agreements, such as but not limited to, rental agreements, service agreements, and other legal documents or agreements related to the rental and operations of a MDU building 105*a*-105*c*. In some embodiments, the agreements module may be accessed through the documents tab 210 of the user-interface 200. Building owners, managers, and residents may access the agreements, review, and electronically sign the agreements. This module may also provide task management related to the operations of a MDU building. For example, when a new resident is added, tasks are automatically generated to organize and outline action items for the users. Such tasks include one or more agreements related to an individual resident, such as a lease, telephone, cable, and internet agreements, which agreements are created and available in the building owners and residents' profiles for executing (e.g., electronic (e-signing)). When the various agreements are executed, other events may be triggered, such as provisioning of the services ordered, programming a resident's fob into the smart building system 100, as well as other tasks performed when a new resident moves into a MDU building. In some embodiments, task management and order tracking may be provided in the work orders module, apart from the agreements module. In some embodiments, these tasks may be accessed by selecting "tasks" from the dropdown menu 245 of the other tab 240 of the user-interface 200.

The work orders module creates and manages tasks relating to building and property management. For example, residents may take a picture with a mobile device and send an SMS message to a given number for the work orders modules. The work orders module may then automatically generate a work order and create tasks for the building manager to respond to. The work order may be assigned a unique number within the work orders module. A work order represents an overall goal, for example repairing a broken window. The tasks represent steps to complete the goal, for example temporarily patching the broken window, ordering replacement parts, and installing replacement parts to effect the repair. The work orders module tracks communications between the manager and the resident. The communications are saved in the work orders module, and tied to the work order number. The module provides reporting features, which may report the work orders for a particular building, resident, floor, vendor, or other characteristic. In some embodiments, the work orders module may be accessed by selecting "work orders" from the dropdown menu 245 of the other tab 240 of the user-interface 200.

The messaging module enables electronic communications between building owners, managers, and residents. The messaging module provides internal messaging systems, including but not limited to, electronic message boards, electronic message forums, instant messaging, and e-mail-type messaging. The messaging module may be configurable to interface with external communications systems including mobile devices, email, SMS, MMS, external websites, the VoIP system, and other suitable electronic communications systems. Users may communicate by sending messages within the messaging module, or through the messaging module to external communications systems associated with the users. The messaging module may be capable of tracking and recording all electronic messaging and correspondence. Some embodiments of the invention utilize the messaging module to provide social or community media services. The social or community media services allow the residents to interact electronically using the portal 120. For example, residents may post electronic messages to each other that, among other things, offer or seek items and/or services for sale, organize community events, or exchange information (e.g., about a new business around the corner, upcoming events in the area, etc.). In some embodiments, the messaging module may be accessed by selecting the relation tab 250 of the user-interface 200.

The notices module allows the building owner or manager to create, send, and track official notices to residents. For example, a building owner may create a five-day notice and send the notice to all residents with a balance in excess of a specified amount (e.g., $100 in arrears). The notices module requires residents to respond to the notices within a specific time, or it may automatically shut the residents out of certain services. For example, in such a situation, when a resident has not responded to such a notice within the specific time, any attempt to access the internet may redirect the resident's browser to a page where he or she may pay the owed amount. In another example, a resident's key fob may still open the doors to his or her building and apartment, but not the doors to amenity rooms (e.g., the fitness room). In some embodiments, a resident may see these notices in the pending task tab 235 of the user-interface 200.

The alerts module allows building owners or managers to send an alert to the residents of any one unit, group of units, or building. The alerts module may also be used to inform residents of upcoming projects or events that will affect their use of their units or the building, including construction projects, painting, the temporary closure of parking lots, temporary closure of amenities (e.g., swimming pools or fitness rooms), or other portions of the building or grounds. In one example, the manager may be repainting a hallway. Prior to the repainting, the manager uses the alert module to issue an alert to the residents for all units along that hallway, informing residents of the painting and any special measures that may need to be taken in light of the painting. The module tracks user acknowledgements, and notifies the manager of any residents who have not acknowledged the alert within a specified time period. The manager may then follow up with those residents to ensure the residents are aware of the upcoming event.

The orientation module is an online training module configured to introduce residents to the portal 120 and the building systems and procedures. Proper orientation may increase resident satisfaction, while decreasing turnover and maintenance. The orientation module may take residents through an orientation class using videos and interactive questions. The training module may include a progress bar or other visual indicator to inform residents of where the resident is in the process. The module may be configured to allow the resident to pause and continue at a later time. Some embodiments of the module include sending the residents a multi-digit code via SMS periodically during the orientation to promote active participation. The residents must enter the code to verify their participation, and proceed with the next step in the orientation.

Each user has a profile through the profile's module. A profile allows a user to interact with the portal 120. In some embodiments, the interaction with the portal 120 may include signing lease documentation, paying for laundry services, notifying tenants of construction in a building, automatically controlling services to tenants, or sending an alert or other interactions. The interaction with the portal 120 may be used in the messaging module, alerts module, notification module, or one or more other modules. When a building owner creates a resident account in the profiles module, each resident's profile will store an email address and a mobile phone number associated with the resident. In one embodiment, when a resident logs into the portal 120 for the first time, the portal 120 may be configurable to implement a two-stage authorization process for the resident account. The process requires the resident to first authenticate with a username and password, and then provides a second one-time authentication code to the resident via an email or text (SMS) message.

In addition to residents, other users may have a profile. The users may include agents, brokers, service providers, residents, building owners, contractors, employees, or other users. In some embodiments, no third party companies may be involved in the process. Each user has their own library of documents that the user may reference for their entire portfolio or to specific cities or buildings. By simply selecting the building, followed by a specific subset of users, or all users, communication can be quickly distributed. Documents can be edited and versions are automatically created when the document is saved.

The building owner or manager may communicate with a user using authenticated documents. In some embodiments, the authentication process includes three levels of authentication. The first level is a broadcast without a response (i.e., an email or SMS). In the second level, the recipient must acknowledge receipt before viewing the document using a password, through email, SMS, or another means of communication. The third level requires a signature and the document creator must select a priority level of the document. If the priority level is one, there will be no adverse action for cases where a user does not view the document. In some embodiments, these level-one cases may be an advertisement or information about a social activity that is not necessary for a resident to view. If the priority level is two, the recipient must acknowledge receipt within a specified number of days or be subject to a limitation of benefits or services as described later. If the priority level is three, a document or action step is required by the recipient, such as an e-signature. The requirement of a document or and action step may also be applied to level-two (i.e. a five-day notice needing receipt acknowledgement or a lease addendum requiring an e-signature).

Figure 3:
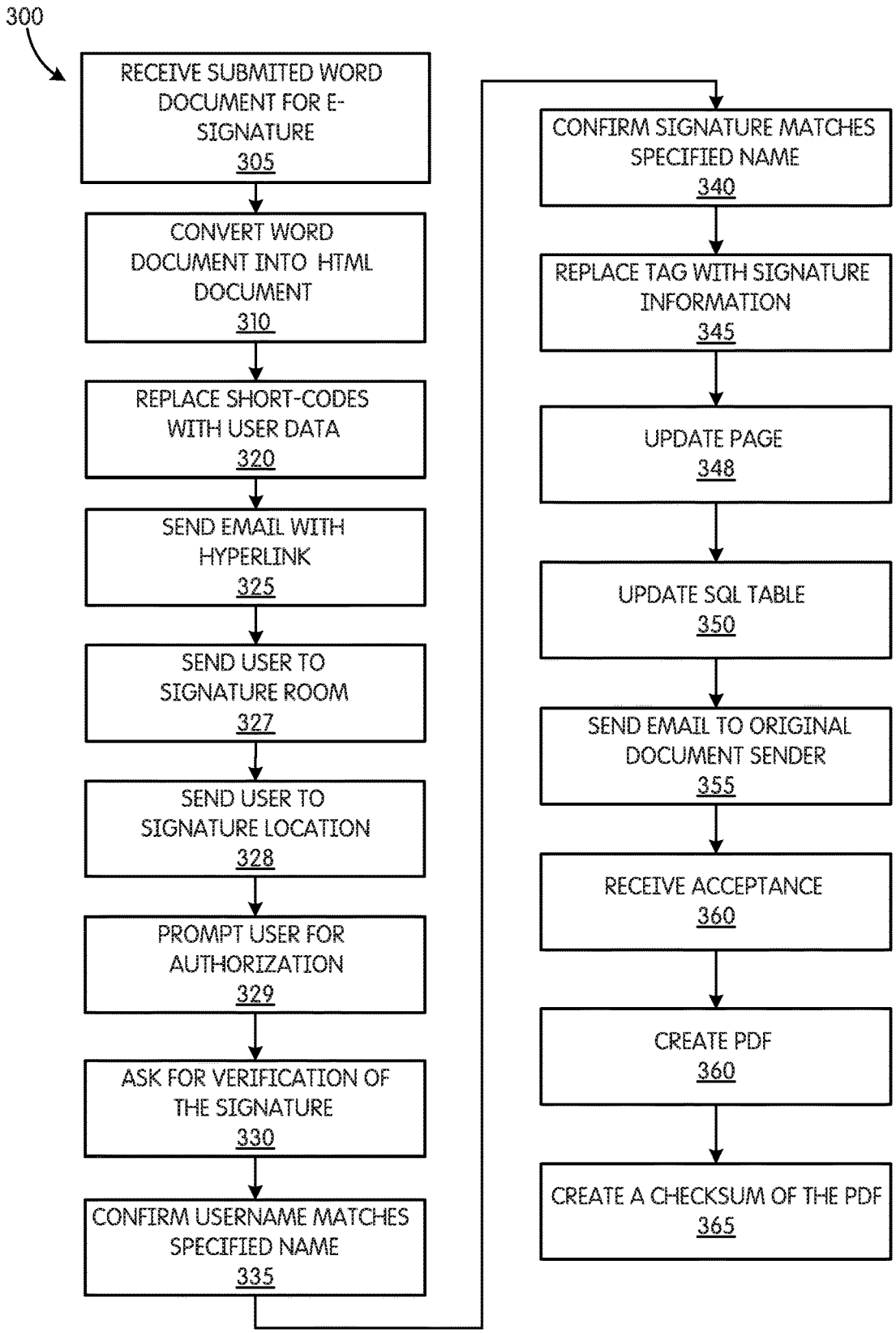
FIG. 3 is a flow chart of the e-signature process used to authenticate documents according to some embodiments.

Embodiments of the invention provide user verification for residents signing documents or using the portal 120 with the user-interface 200 using an e-signature. FIG. 3 is a flow chart illustrating an exemplary method 300 for an e-signature process used to authenticate documents. In some embodiments, once a profile is created and authenticated, a user may utilize e-signature to authenticate documents. The documents may, for example, be a lease agreement, five-day notice, invoice, and/or personal message. As an example, the s-signature process is described in terms of a Word document. This should not be considered limited. The methods described herein are applicable to other types of electronic documents. The e-signature process begins at step 305 when the smart building system 100 receives, from a user, a submitted Word document to obtain an e-signature. When submitting a Word document, the user specifies the other users whose signatures are required. In some embodiments, the user designates a priority level at step 305 when submitting the Word document. At step 310, the smart building system 100 converts the submitted Word document into an HTML document for merging with data and signatures. The location for the HTML document is indicated by short-codes. Each short-code may have a unique ID so that the same short-code may be used multiple times.

At step 320, the smart building system 100 replaces the short-codes for the signature with user data. At step 325, the smart building system 100 sends an email using the portal 120, to the each user whose signature is required. If multiple signatures are required, then multiple emails may be sent at step 325. Each email may include a link that sends the user to the signature room. When a user clicks the link, the smart building system 100 sends the user to the signature room at step 327. Alternative embodiments may use alternate forms of electronic messaging (for example, SMS messaging) to alert users that a signature is required. In the signature room, a floating legend may include a list of quick access to signature fields required for the document. At step 328, the user may select one of the signatures to be taken to the signature location. At step 329, the user clicks a signature block and may be prompted to type in their name in each block or in some embodiments, autofill may aid in the process. In some embodiments, the user may only be required to type in their initials on a page by page basis. At step 330, an ajax call is sent to a server that asks for verification of the signature. At step 335, the smart building system 100 confirms that the username of the user matches one of the names specified for e-signatures by the user who originally submitted the Word document at step 305. At step 345, the smart building system 100 confirms that the signature of the user matches one of the names specified for e-signatures by the user who originally submitted the Word document at step 305. Steps 335 and 340 may be performed multiple times, for each signature required by different users.

At step 345, the smart building system 100 replaces the tag for the link with information about the signature. In some embodiments, for example but not limited to, in a document that requires multiple signatures, the information about the signature may include a unique confirmation of the actual user with multiple authentication steps including a unique email link, one time password, and other methods of authentication. At step 348 the user-interface page is updated. The page update may be an update that takes place on the user-interface 200 on a phone, tablet, computer, or anther device. At step 350, the smart building system 100 updates the structured query language (SQL) table to indicate the signature is complete. Alternative embodiments may use a data storage format other than SQL. At step 355, when all e-signatures have been completed that are required for the document, the smart building system 100 sends an email to the user that submitted the document for e-signature at step 305. When the user accepts the document with the e-signature, then the smart building system 100 creates a PDF version of the document at step 360. At step 365, the smart building system 100 creates a checksum of the PDF that becomes the archived version of the document. The smart building system 100, using the method 300 can be used to achieve compliance with the E-signature Act, and provide for a verified, more secure, and tamper-resistant signature process.

Other embodiments of the invention may provide support for the eviction process. The portal 120 may keep track of legal documents and other criteria that may be used in the eviction process. For example, the portal 120 may store day notices, tracking of acknowledgements received, notices of non-performance of lease obligations and other documents in a location for the building owner or manager to easily access should the owner or manager consider or pursue eviction of a resident.

Other embodiments of the invention provide multimedia messaging service (MMS) verification processes. Certain activities in the smart building system 100, for example signing documents or ordering a new service, may require user verification using MMS verification. If a resident wishes to sign a document, the smart building system 100 may send the resident an SMS message prompting the user to respond with images of the front and back of the resident's government-issued identification card. The smart building system 100 receives the images, stores the images, and performs optical character recognition (OCR) on the images. The smart building system 100 is configured to read the OCR data, and extract and store the name, address, and date of birth of the resident, and the expiration date of the ID card. The smart building system 100 is also configured to read and extract data from any bar codes on the ID card. The smart building system 100 then compares the extracted data to the data on file in the resident's profile. If the data matches, the resident is verified, and the smart building system 100 allows the document to be executed. In some embodiments the data match may be based on a one time password provided on a registered phone number.

The foregoing features and modules of the portal 120 displayed on the user-interface 200 operate to provide building owners, managers, and residents with property management tools, legal management tools, payment gateways, facilities management tools, utility management tools, risk management tools, and social or community media services.

Figure 4:
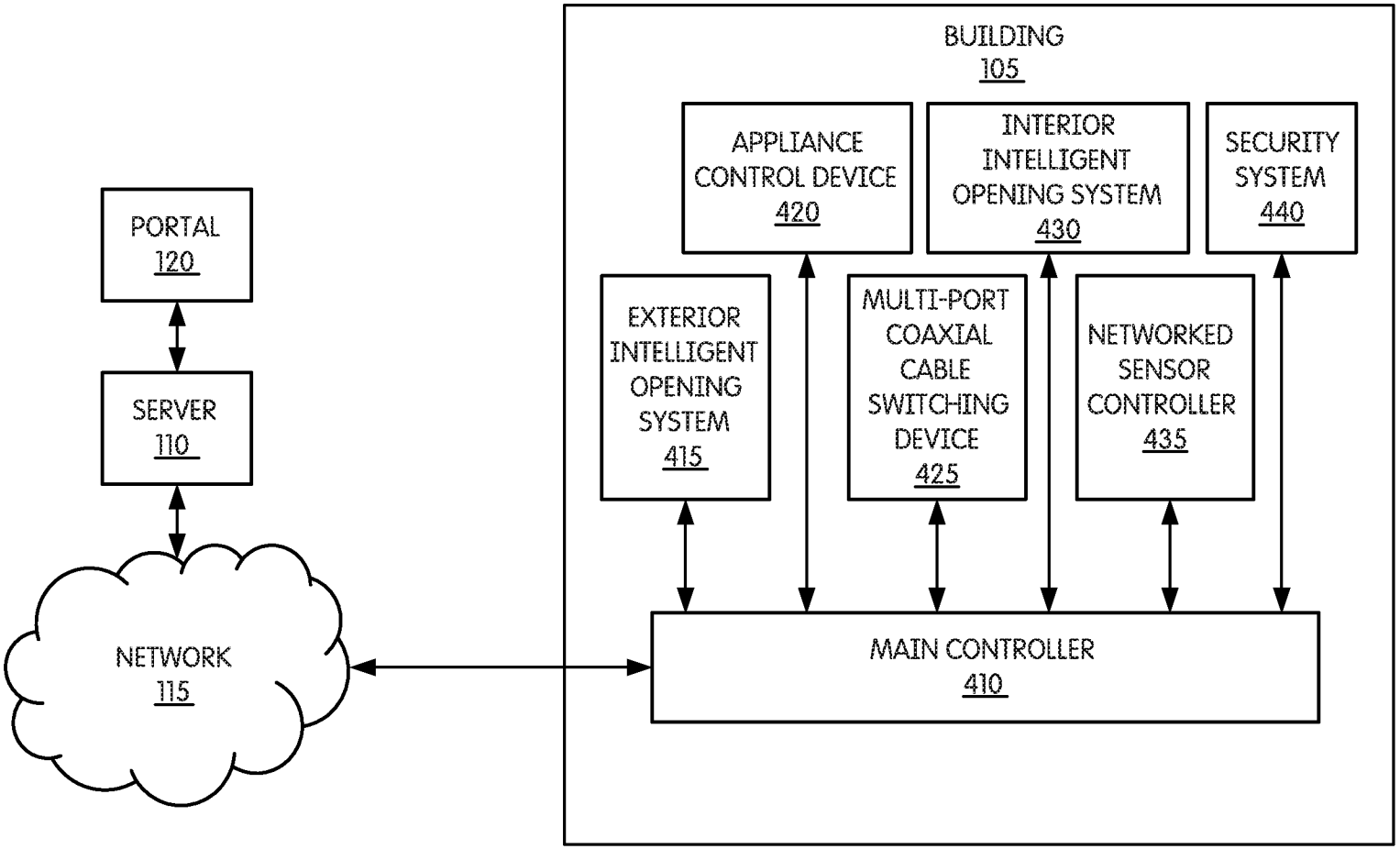
FIG. 4 is a block diagram of the smart building system implemented into an individual building according to some embodiments.

FIG. 4 is a block diagram of an exemplary embodiment individual building 105 (e.g., MDU building 105*a*-105*c*) of the smart building system 100 of FIG. 1. As illustrated, building 105 may be communicatively coupled to the server 110 through network 115 and may be accessed by the portal 120. The building 105 may include a main controller 410, an exterior intelligent opening system 415, an appliance control device 420, a multi-port coaxial cable switching device 425, an interior intelligent opening system 430, a networked sensor controller 435, and a security system 440.

The main controller 410 is configured to communicate and/or control one or more individual systems of the building 105. In some embodiments, the main controller 410 includes a plurality of electrical and electronic components that provide power, operational control, and protection to the components and modules within the main controller 410 and/or the smart building system 100. For example, the main controller 410 includes, among other things, a processing unit (e.g., a microprocessor, a microcontroller, or another suitable programmable device), a memory, input units, and output units. The processing unit includes, among other things, a control unit, an arithmetic logic unit ("ALU"), and a plurality of registers, and may be implemented using a known computer architecture, such as a modified Harvard architecture, a von Neumann architecture, etc. The processing unit, the memory, the input units, and the output units, as well as the various modules connected to the main controller 410 are connected by one or more control and/or data buses (e.g., common bus). The use of one or more control and/or data buses for the interconnection between and communication among the various modules and components would be known to a person skilled in the art in view of the invention described herein. In some embodiments, the main controller 410 may be implemented partially or entirely on a semiconductor (e.g., a field-programmable gate array ["FPGA"] semiconductor) chip, such as a chip developed through a register transfer level ("RTL") design process.

The memory includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit may be connected to the memory and executes software instructions that are capable of being stored in a RAM of the memory (e.g., during execution), a ROM of the memory (e.g., on a generally permanent basis), or another non-transitory computer readable medium such as another memory or a disc. Software included in the implementation of the smart building system 100 can be stored in the memory of the main controller 410. The software includes, for example, firmware, one or more applications, program data, filters, rules, one or more program modules, and other executable instructions. The main controller 410 may be configured to retrieve from memory and execute, among other things, instructions related to the control processes and methods described herein. In other constructions, the main controller 410 includes additional, fewer, or different components.

In some embodiments, the main controller 410 communicates with other systems using a local area network (LAN). The LAN may be wired or wireless, and operates using Ethernet, Wi-Fi, or another suitable network protocol. The LAN may connect the main controller 410 to all of the manageable building systems such as, but not limited to, the exterior intelligent opening system 415, appliance control device 420, multi-port coaxial cable switching device 425, and interior intelligent opening system 430. These systems will be explained in greater detail below. In some embodiments, the main controller 410 may be communicatively coupled to any number of systems not illustrated in the embodiment of FIG. 4.

Figure 5:
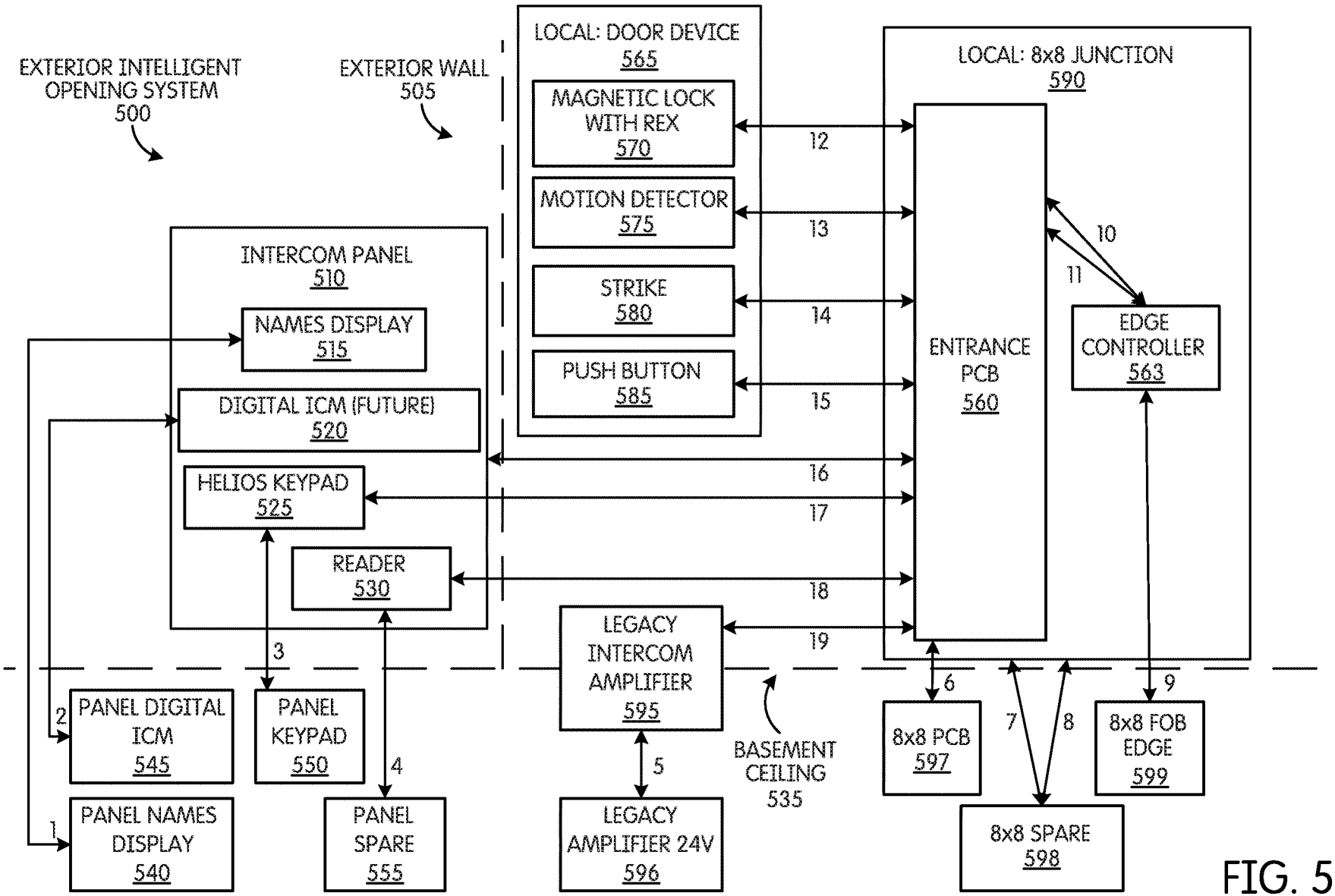
FIG. 5 is a block diagram of an exterior intelligent opening system of the smart building system of FIG. 4 according to some embodiments.

FIG. 5 is a block diagram illustrating an embodiment of an exterior intelligent opening system 500 of the smart building system 100 of FIG. 4. The exterior intelligent opening system 500 includes an intercom panel 510, a local door device system 565, and a local 8×8 junction 590. The exterior intelligent opening system 500 allows for secure opening and closing of one or more exterior doors using a means of entrance, such as a fob or Bluetooth via a phone, or through the portal 120. Connections 1-9 may be long-distance connections (e.g., homerun connections in excess of approximately twenty-five feet in length). Connections 10-19 may be local short-distance connections (e.g., connections less than approximately twenty-five feet in length).

The intercom panel 510 may be located on an exterior wall 505 of the building 105. The intercom panel 510 includes a names display 515, a digital ICM 520, a helios keypad 525, and a reader 530.

The names display 515 displays the names of current residents residing in the building 105. The names of current residents residing in the building 105 are quickly and automatically updated with information from the portal 120, such as but not limited to, from the information on the users tab 215.

In some embodiments, the names display 515 provides a touch screen interface, where a user may touch a name on an interface to call a resident. The names display 515 may display the names of all of the residents along with other designated information (i.e., resident unit number) on an interactive user interface. Then, when a name is touched, a call may be placed with simultaneous rings to a resident or the call may be placed only to security to provide complete guest access control. The names display 515 replaces the push-button door panel, while providing two-way communication between the guest and resident. When a call is made from the door phone, the call may be made to the server running on the device computer. The call uses a breakout board to signal the unit via a relay. The appropriate relay may be selected using the device computer general purpose input/output (GPIO) and multiplexers to virtually push the button to call the unit. Then, the audio of the call may be routed through the legacy intercom system so that the person at the door phone can talk to the person in the unit. When the button is pushed on the resident wall panel, the action may activate the intercom board to release the given door. In some embodiments, the digital ICM 520 may replace the names display 515.

The names display 515 may be connected to the panel names display 540. In some embodiments, the names display 515 may be connected to the panel names display 540 at a demarcation point located below the basement ceiling 535.

The digital ICM 520 manipulates legacy signals of pre-existing legacy systems in the building. In some embodiments, the manipulation of old signals may include converting analog signals into digital signals. For example, the digital ICM 520 may integrate with existing legacy intercom wiring and resident wall panels. In another embodiment, the digital ICM 520 may be used to replace existing resident wall intercom panels with a user's cellular telephone. The digital ICM 520 may be connected to the panel digital ICM 545. In some embodiments, the digital ICM 520 may be connected to the panel digital ICM 545 at a demarcation point located below the basement ceiling 535.

The intercom panel 510 may also include the helios keypad 525 which may be a user input keypad for entering an entrance code or a similar user input (e.g., fingerprint, voice activation, etc.) for unlocking the door. In some embodiments of the invention, the helios keypad 525 may include a camera and a phone. The helios keypad 525 may be communicatively coupled to the panel keypad 550 and the entrance PCB 560. In some embodiments, the helios keypad 525 may be coupled to the panel keypad 550 at a demarcation point located below the basement ceiling 535. Additionally, in some embodiments, the helios keypad 525 may be coupled to the entrance PCB 560 at a demarcation point located outside the exterior wall 505. The reader 530 may also be included on the intercom panel 510 and may be communicatively coupled to a panel spare 555 and the entrance PCB 560. The panel spare 555 may be coupled to numerous locations and devices so that in the event of a cable failure, the panel spare 455 will enable a repair person to quickly bring a device back online. In some embodiments, the intercom panel 510 may be coupled to the panel spare 555 and the entrance PCB 560 at a demarcation point located below the basement ceiling 535. In some embodiments, the reader 530 may be controlled by RFID (e.g., HID brand), or another type of reader, for example but not limited to, activated using Bluetooth on a phone or other device, a fob, an access card, or a different means of activation. In some embodiments of the invention, the reader 530 or another alternative device may read a finger print and/or a face for facial recognition.

The local door device system 565 controls the exterior door of the building 105. The local door device system 565 may include a magnetic lock with a built-in request-to-exit (REX) 570, motion detector 575, strike 580, and a push button 585. The local door device system 565 may be communicatively coupled to an entrance PCB 560. In particular, the magnetic lock with REX 570 may be communicatively coupled to the entrance PCB 560 for electromagnetically locking and unlocking the exterior door. The motion detector 575 may detect motion and controls the physical motion of the door opening and closing when a door pulls in to open. The signal to execute the motion may be received from the entrance PCB 560. The strike 580 may be communicatively coupled to the entrance PCB 560. In some embodiments, the strike 580 is an electric stike plate lock. The push button 485 may be communicatively coupled to the entrance PCB 560 and allows a person to open the door by pushing a button, such as a handicap door opener or a button located inside an individual unit of the building 105.

The interior of the building may also include a local 8×8 junction 590 that contains the entrance PCB 560 and an edge controller 563. The entrance PCB 560 provides conversion of a pre-existing (e.g., legacy) building to a smart building. The entrance PCB 560 provides routing of communication and power for devices of the system 100. The entrance PCB 560 also includes built in relays to time and coordinate communication and access between all intelligent opening devices. The entrance PCB 560 may control smart electromagnetic locks, normal magnetic locks, and electric door strikes (e.g., strike 580). The entrance PCB 560 may provide independent power to a push-to-exit button. The entrance PCB 560 also manages communication for fob access and inputs from REX and motion detectors. The entrance PCB 560 also manages communication between the helios keypad 525 and the strike 580.

The entrance PCB 560 may be communicatively coupled to a legacy intercom amplifier 595 that is coupled to a legacy amplifier 496. The entrance PCB 560 controls communication traffic with the legacy intercom amplifier 595. The legacy intercom amplifier 595 obtains legacy system signals, such as from a legacy intercom for conversion into digital signals to be used in the smart building system 100. The legacy intercom amplifier 595 receives power and signals from the entrance PCB 560.

In some embodiments, the legacy intercom amplifier 595 activates a door when a person pushes a button on a legacy intercom system. When the button is pushed, a relay on the ICM board provides a contact closure signaling an event to a door controller such as an FOB access controller on the exterior door. The door controller may be responsible for granting access to any requests from any part of an interior intelligent opening system or an exterior intelligent opening system to release doors. The door controller sends an http request to the onsite server. The onsite server sends a grant-access to the exterior door. When the door controller opens the door, a signal may be sent to the ICM board that may release the door strike to the exterior door. The onsite server captures images of the guest entering the building from a door phone camera. The onsite server sends a grant to the interior door allowing the guest to enter the second door. In some embodiments of the invention, the door controller may use its own internal database to determine if a user needs access. In some embodiments, if the network is down, the door controller may operate as a stand-alone unit, independent from the portal 120. In such an embodiment, changes made to the portal 120 are then made to the door controller.

The entrance PCB 560 may also connects to an 8×8 PCB 597 and an 8×8 spare 598. The 8×8 spare 598 may be an extra wire that enables a technician to quickly fix a problem in the event that a wire is damaged. The 8×8 spare may also be used to install a new device such as a camera. In some embodiments, the PCB 560 connects to the 8×8 PCB 497 and the 8×8 spare 498 at a demarcation point located below the basement ceiling 535. In addition to the entrance PCB 560, the local 8×8 junction 590 includes an edge controller 563 that may be communicatively coupled to the entrance PCB 560. In some embodiments, the edge controller 563 may be a FOB controller that receives access request from a FOB reader, an intercom, the portal 120, or a door phone.

In some embodiments, all of the features below the basement ceiling 535, including the panel digital ICM 545, panel names display 540, panel keypad 550, panel spare 555, legacy amplifier 24V 596, 8×8 PCB 597, 8×8 spare 598, and 8×8 FOB edge 599, may be replaced with a POE switch that is connected to a main controller 410. In some embodiments, the demarcation point may be a rack that houses the main power over Ethernet (POE) switch.

Figure 6:
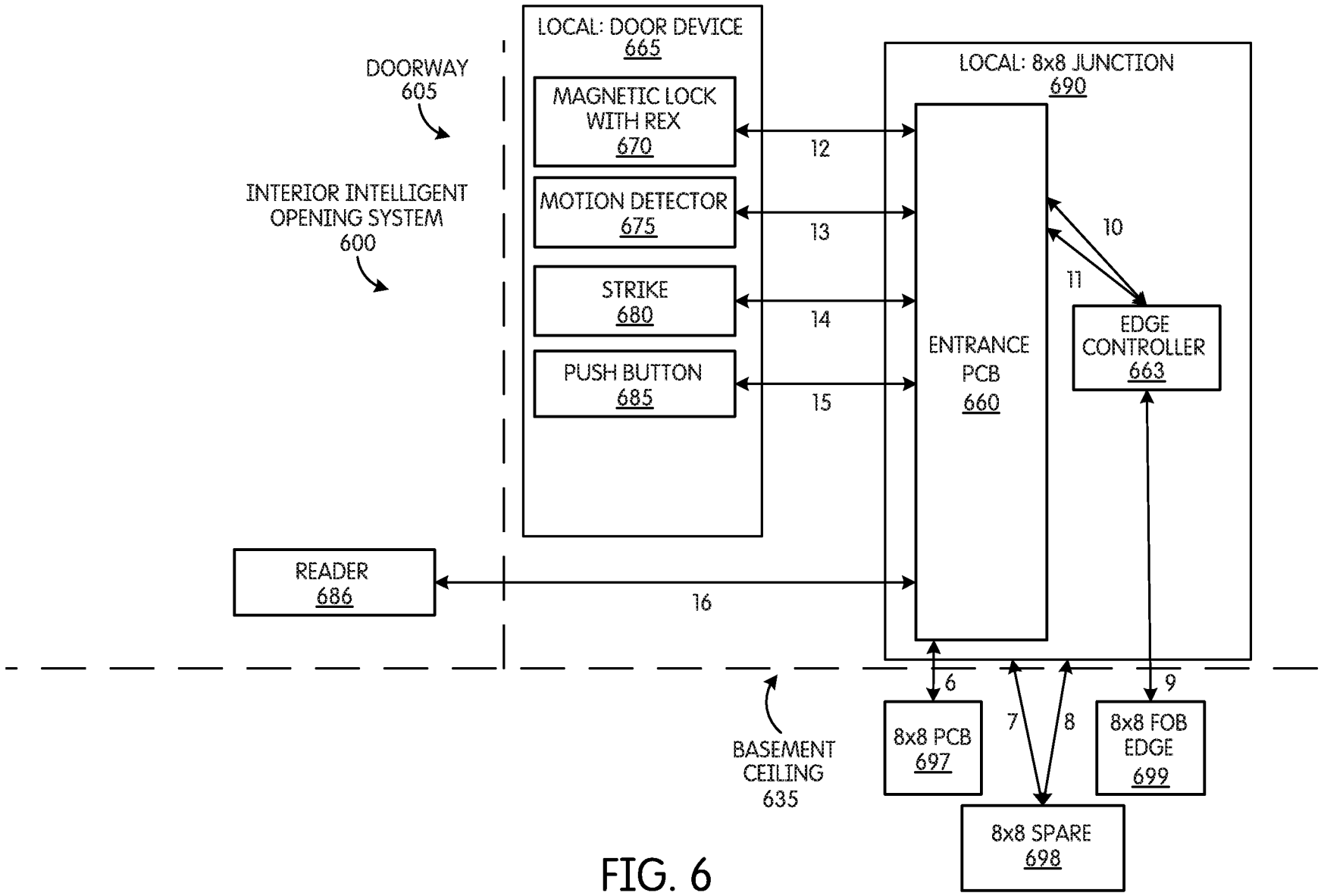
FIG. 6 is a block diagram of an interior intelligent opening system of the smart building system of FIG. 4 according to some embodiments.

FIG. 6 is a block diagram of an interior intelligent opening system 600 of the smart building system 100 of FIG. 3 according to some embodiments of the present invention. The interior intelligent opening system 600 allows for secure opening and closing of an interior door, such as a door to a resident unit, a workout room, pool, or other amenity room. The interior intelligent opening system 600 includes a local door device system 665, a reader 686, and a local 8×8 junction 690. The interior intelligent opening system 600 allows for secure opening and closing of the one or more interior doors using a means of entrance, such as a fob, or through the portal 120. Connections 5-9 are long-distance connections. Connections 10-16 are local short-distance connections meaning the connections are local cables that are up to twenty-five feet in length.

A local door device system 665 may be on the interior of the building 105 for controlling an interior door. The local door device system 665 includes the magnetic lock with REX 570, motion detector 675, strike 680, and push button 685. The local door device system 665 may be communicatively coupled to the entrance PCB 660. In particular, the magnetic lock with REX 670 may be communicatively coupled to the entrance PCB 660 for electromagnetically locking and unlocking the door. The motion detector 675 detects motion and controls the physical motion of the door opening and closing when a door pulls in to open. The signal to execute the motion may be received from the entrance PCB 660. The strike 680 may be communicatively coupled to the entrance PCB 660. In some embodiments, the strike 680 is an electric stike plate lock. The push button 685 may be communicatively coupled to the entrance PCB 660 and allows a person to open the door by pushing a button, such as a handicap door opener or a button located inside a unit of the building 105. The local door device system 665 also includes a reader 686 communicatively coupled to the entrance PCB 660. In some embodiments, the reader 686 may be communicatively coupled to the entrance PCB 660 using a shielded connection that may be up to 30 feet long.

The reader 686 may be located outside the doorway 605 and may be controlled by RFID (e.g., HID brand), or the reader 686 may be another type of reader, for example, but not limited to, activated using Bluetooth on a phone or other device, a fob, an access card, or another means of. The reader 686 may be communicatively coupled to the entrance PCB 660. In some embodiments of the invention, the reader 530 or another alternative device may read a finger print or a face for facial recognition. In some embodiments, the reader 686 may read a virtual FOB embedded into a smart phone through Bluetooth.

The interior of the building also includes a local 8×8 junction 690 that contains the entrance PCB 660 and an edge controller 663. The entrance PCB 660 provides conversion of a pre-existing (e.g., legacy) building to a smart building. The entrance PCB 660 provides routing of communication and power for devices of the smart building system 100. The entrance PCB 660 may also include built in relays to time and coordinate communication and access between all intelligent opening devices. The entrance PCB 660 may control smart electromagnetic locks, normal magnetic locks, and electric door strikes. (e.g., strike 580). The entrance PCB 660 may provide independent power to a push-to-exit button. The entrance PCB 660 also manages communication for fob access and inputs from a magnetic lock with REX 670 and motion detectors.

The entrance PCB 660 may also connect to an 8×8 PCB 697 and an 8×8 spare 698. The 8×8 spare 698 may be an extra wire that enables a technician to quickly fix a problem in the event that a wire is damaged. The 8×8 spare may also be used to install a new device such as a camera. In some embodiments, the entrance PCB 660 may be coupled to the 8×8 PCB 697 and the 8×8 spare 698 at a demarcation point located below the basement ceiling 635.

The edge controller 663 may connect to the entrance PCB 660 and an 8×8 FOB edge 699. In some embodiments, the edge controller 663 may be a FOB controller that receives access request from a FOB reader, an intercom, the portal 120, or a door phone. In some embodiments, the edge controller 663 may be connected to the 8×8 FOB edge 699 at a demarcation point located below the basement ceiling 635. The 8×8 FOB edge may be a controller. In some embodiments, the edge controller 663 may be connected to the entrance PCB 660 with a 2-inch shield.

In some embodiments, all of the features below the basement ceiling 635, including the 8×8 PCB 697, 8×8 spare 698, and 8×8 FOB edge 699, may be replaced with a POE switch that is connected to a main controller 410. In some embodiments, the demarcation point may be a rack that houses the main POE switch.

Figure 7:
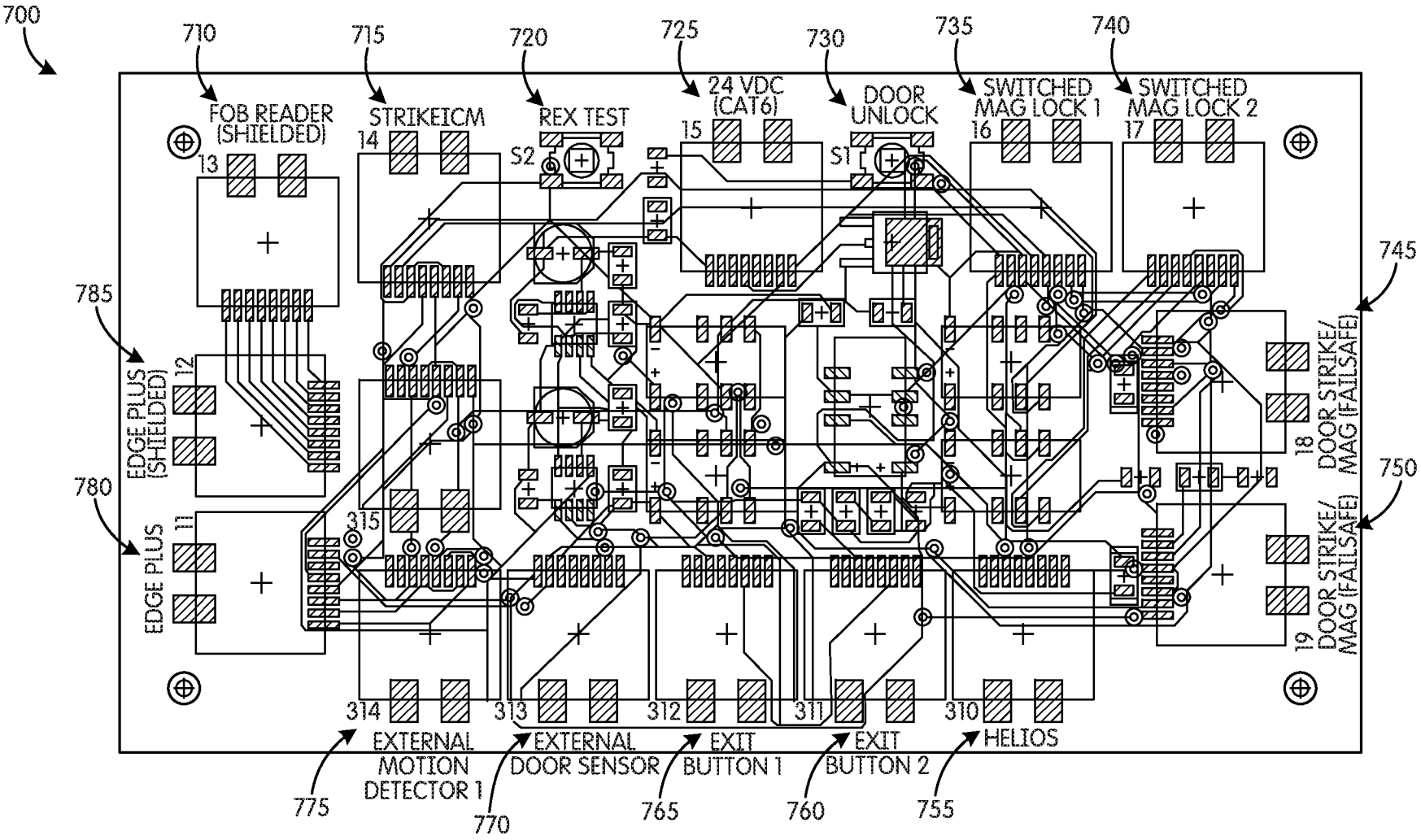
FIG. 7 is a schematic of an entrance printed-circuit board (PCB) of the exterior intelligent opening system and interior intelligent opening system of FIG. 5 and FIG. 6 according to some embodiments.

FIG. 7 is a schematic of an entrance printed-circuit board (PCB) 700 of the exterior intelligent opening system 500 and interior intelligent opening system 600 of FIG. 5 and FIG. 6 according to some embodiments of the present invention. The entrance PCB 700 includes a number of connections for various outputs including a shielded fob reader 710 for reading a fob access card, or other device, a StrikelCM 715, a REX test 720, a 24 VDC power supply 725, a door unlock 730, a switched magnetic lock 1 735, a switched magnetic lock 2 640, a door strike magnetic fail safe 745, a second door strike magnetic fail safe 650, a helios keypad 655 for user input, a first exit button 765, a second exit button 760, an exterior door sensor 770, and external motion detector 775, an Edgeplus 780, and a shielded Edgeplus 785. All of these connections are connectively coupled as shown in FIG. 6 and FIG. 7 to other systems such as the local door device systems.

In some embodiments, the MDU buildings **105*a*-105*c* using the intelligent opening systems of FIG. 5-FIG. 7 may have electromagnetic door locks equipped with sensors, a position sensor (also known as a door open alarm), a tamper alarm, and a door forced alarm. These reader-controlled door locks used in both the exterior intelligent opening system 500 and the interior intelligent opening system 600 are deployed at exterior building entrances, entrances to certain public and private areas of the building, and resident units. Readers 530 and 686 may also control access to garages, storage units, gated communities, elevators, or any other area of the building or grounds where access may be limited. Residents are issued a RFID fob, and building owners, using the portal 120, may setup building access for residents. In one example, a resident's fob might grant him access to his unit's parking lot, all ground floor entrances, his unit, a workout room, his storage unit, a laundry facility on his floor, and his garage, but deny him access to a basement entrance, parking lots for other units on the grounds, and all other restricted areas. The resident's fob may also provide access to other amenities in the building, such as the laundry service, as described below. The use of the exterior intelligent opening system 500 and the interior intelligent opening system 600 makes a building more secure. For example, if a resident loses his fob, the building owner simply needs to disable that fob in the smart building system 100. Use of the fob may be tracked by the smart building system 100 for security or other reasons. For example, if a resident is behind on his rent, a building owner may have the smart building system 100 alert him when the resident enters the building. A resident may also use the portal 120 to gain access to an entrance. In some embodiments, the resident may select an entrance using the user-interface 200** and enter a security code to open the door.

In some embodiments access to the building 105 may also be controlled through integration with the VOIP system, which allows residents to receive a video phone call from a guest requesting access at a building entrance equipped with a VOIP video phone. The call from the guest may be received on a phone in the resident's unit, or on the resident's mobile phone. Being able to see and speak to the guest improves building security. An input from the resident, entered on the device that received the call, may instruct the exterior intelligent opening system 500 to open the door for the guest.

FIG. 8 is a display 800 of the names display panel 515 of the exterior intelligent opening system 500 and of FIG. 5 according to some embodiments of the present invention. The names display panel shows the names of all residents in a building 105. If a name is updated in the smart building system 100 using the portal 120, such as with the users tab 215 of the user-interface 200 when a new resident moves in, the names display is automatically updated to display the new name and corresponding information such as contact information or a residential unit number. In some embodiments the display 800 may be a touch screen that a user can touch to call a resident.

Figure 9:
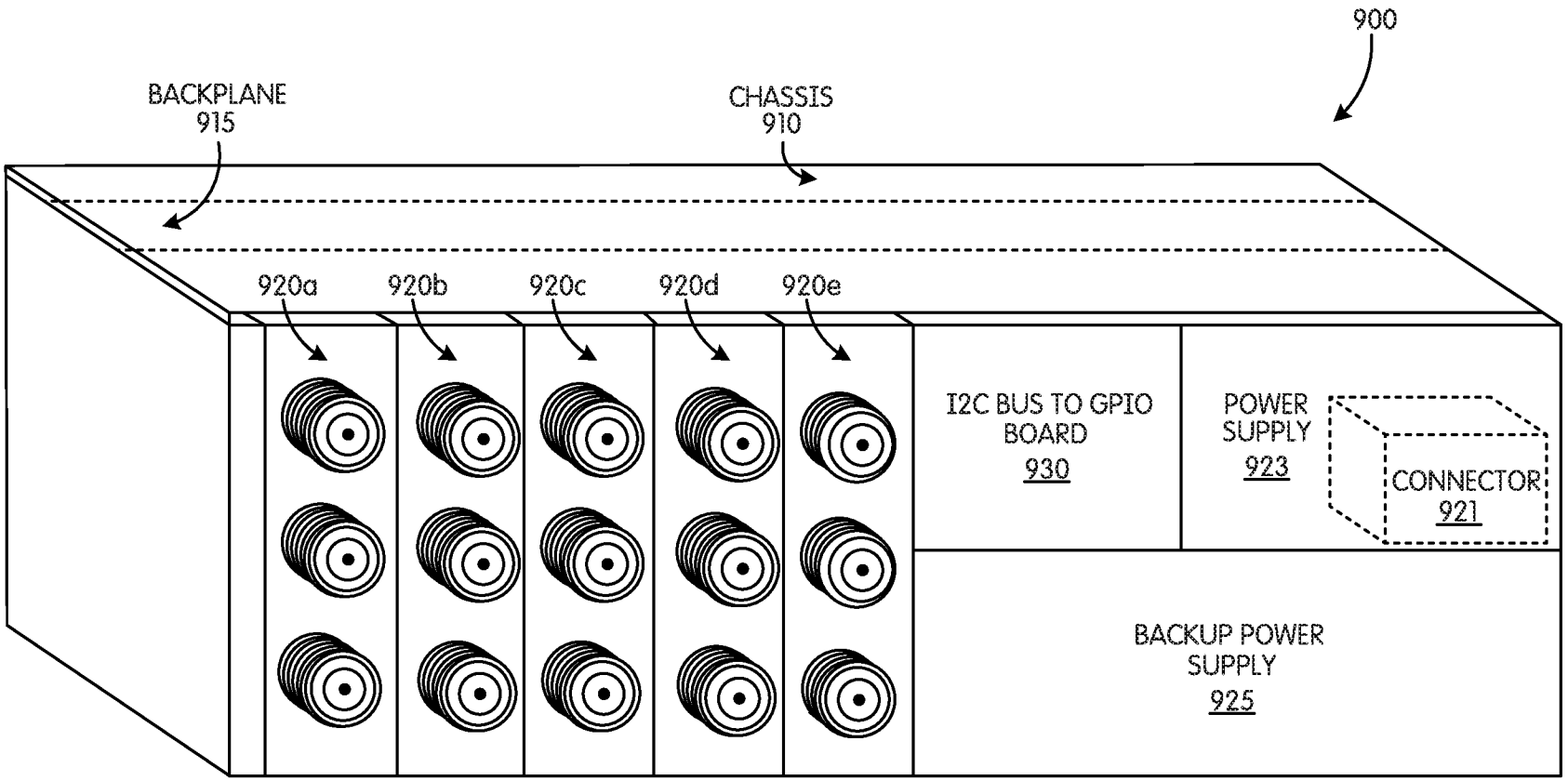
FIG. 9 is a multi-port coaxial cable switching device of the smart building system of FIG. 4 according to some embodiments.

FIG. 9 is a multi-port coaxial cable switching device 900 of the smart building system 100 of FIG. 3 according to some embodiments of the present invention. The multi-port coaxial cable switching device 900 regulates the provision of services to residents. The multi-port coaxial cable switching device 900 includes a chassis 910, an electrical backplane 915, a connector 921, a power supply 923, an I2C to GPIO board 930, a backup power supply 925 via a plurality of rechargeable batteries, and a plurality of coaxial cable switch modules 920*a*-920*e*. The multi-port coaxial cable switching device 900 may be connected to a controller, such as the main controller 410, which communicates with the portal 120. The multi-port coaxial cable switching device 900 may have network plugs to receive POE and to connect to other multi-port coaxial cable switching devices 900.

The chassis 910 may be made of metal or another suitable material. The chassis 910 may be configured such that the coaxial cable switch modules 920*a*-920*e* may be inserted into or removed from the chassis 910. The chassis 910 includes a backplane 915 with electrical connectors for connecting to the backplane connectors on the coaxial cable switch modules 920*a*-920*e*. The backplane 915 provides power and data signaling to the coaxial cable switch modules 920*a*-920*e* over the I2C bus to GPIO board 930. The I2C to GPIO board 930 updates the entire multi-port coaxial cable switching device 900 and stores the state of each coaxial cable switch module 920*a*-920*e*. In some embodiments, the chassis 910 may include bays for housing a control module. In some embodiments, the chassis 910 may be a 2 U Rackmount. Embodiments of the invention may include a robust custom made 2 U front face fits on the chassis 910 with the output ports going through the back wall. In some embodiments, the chassis may be a 2 U with each 1 U having sixteen columns for three inputs.

The power supply 923 may be capable of converting standard alternating current (AC) line power into the appropriate direct current (DC) power needed by the control module and the coaxial cable switch modules 920*a*-920*e*. The power supply 923 may also be capable of recharging the batteries of the backup power supply 925 in the chassis 910, and running the chassis 910 from the backup power supply 925 when line power is unavailable. In some embodiments, the backup power supply 925 may power the multi-port coaxial cable switching device 900 for up to seven days without network communication. Other embodiments of the power supply may include an auxiliary power connector 921 for a backup or alternates source of power such as line power from an external DC power source. Embodiments of the invention may include LEDs to indicate the power source being used by the multi-port coaxial cable switching device 900.

In some embodiments, the multi-port coaxial cable switching device 900 includes a display that permits a self-diagnostic sequence or summarizes the resident units that are turned off or do not have service. The display permits a user to know existing settings for all resident units. In other embodiments of the invention, a built in camera records images of a user accessing the multi-port coaxial cable switching device 900 locally. In another embodiment, local temperature monitoring of the multi-port coaxial cable switching device 900 may be available remotely.

Figure 11:
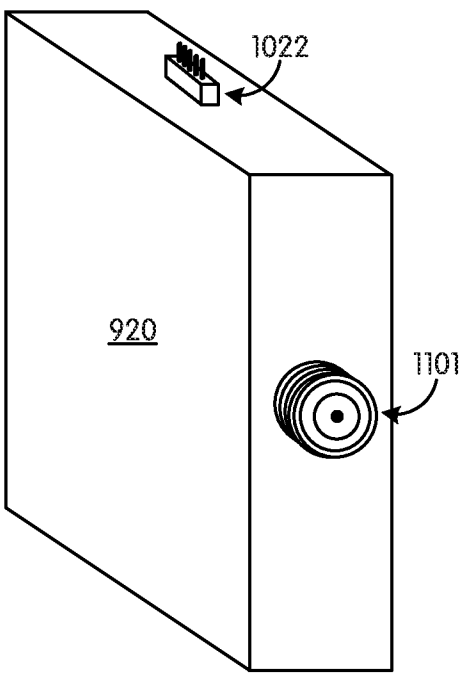
FIG. 11 is a back view of a coaxial cable switch module of the multi-port coaxial cable switching device of FIG. 9 according to some embodiments.
Figure 10:
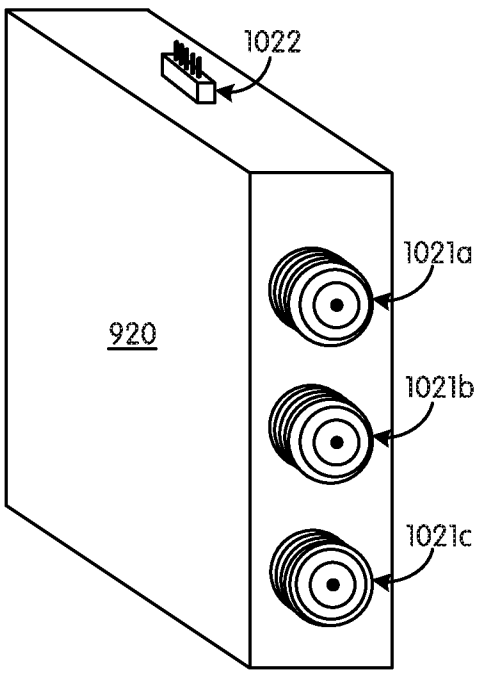
FIG. 10 is a front view of a coaxial cable switch module of the multi-port coaxial cable switching device of FIG. 9 according to some embodiments.

The multi-port coaxial cable switching device 900 includes the coaxial cable switch modules 920*a*-920*e*. In this embodiment, five coaxial cable switch modules 920*a*-920*e* are shown, but any number of coaxial cable switch modules 920*a*-920*e* may be included in the multi-port coaxial cable switching device 900. As shown in FIG. 10 and FIG. 11, each coaxial cable switch module 920 includes input ports 1021*a*-1021*c*, an output port 1001, and an electrical connector 1022. The housing of the coaxial cable switch module 920 may be made of metal or another material suitable to provide RF shielding and isolation.

The input ports 1021*a*-1021*c* may be connected to a service, such as a television service. In this embodiment, the input ports 1021*a*-1021*c* f-connectors, but in other embodiments, the input ports 1021*a*-1021*c* may be configured using another standard connector used with a service system. In such an embodiment, three input ports 1021*a*-1021*c* are shown, but in other embodiments, any number of ports may be included in the coaxial cable switch module 920. In some embodiments, the coaxial cable switch module 920 may have external LEDs to indicate which input port 1021*a*-1021*c* is being used or the LEDs may indicate another performance state of the coaxial cable switch module 920.

The output port 1001 may be connected to a resident unit. In this embodiment, the output port 1001 f-connectors, but in other embodiments, the output port 1001 may be configured using another standard connector used with a service system.

The electrical connector 1020 may be a prong header connector or any other type of connector. The electrical connector may be plugged into the backplane 915 of the multi-port coaxial cable switching device 900. The electrical connector 1022 receives input information from the owner or smart building system 100, such as through a controller. The information from the owner or smart building may be received through the backplane 915. In some embodiments, information communicated over the backplane may include the resident of reasons for service interruption, emergency broadcast, custom messages and advertisements.

Figure 12:
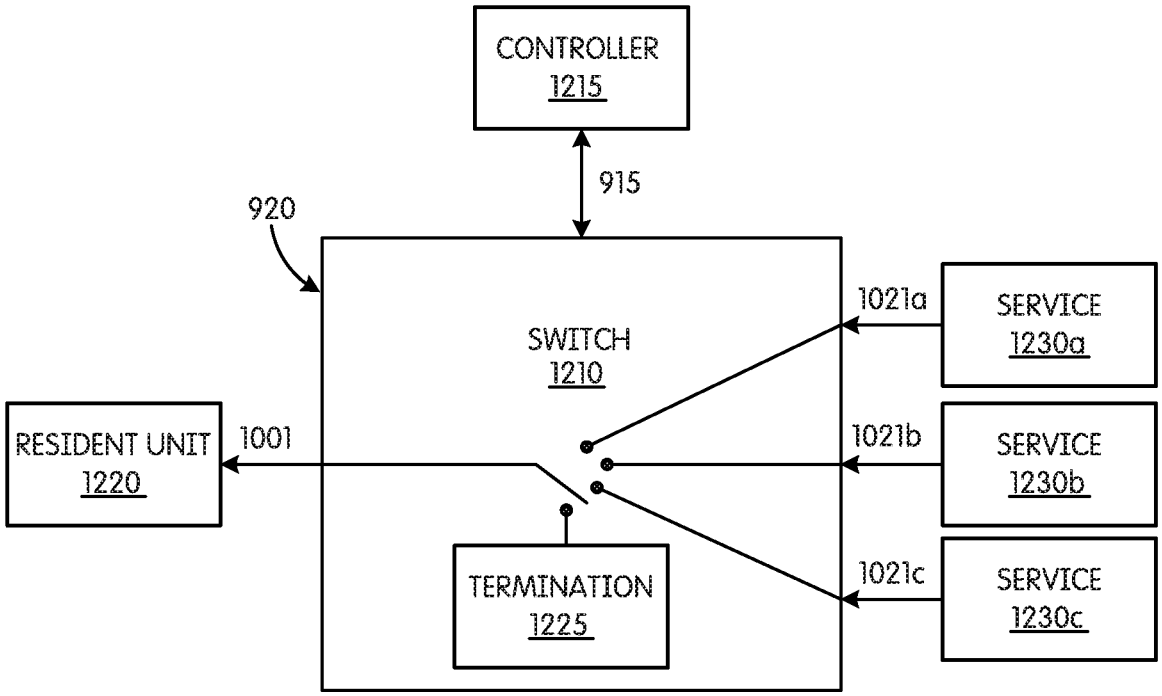
FIG. 12 is a block diagram of a coaxial cable switch module of the multi-port coaxial cable switching device of FIG. 9 according to some embodiments.

FIG. 12 is a block diagram of a coaxial cable switch module 920 of the multi-port coaxial cable switching device 900 of FIG. 9 according to some embodiments of the present invention. The coaxial cable switch module 920 may be connected to a controller 1215, services 1230*a*-1230*b*, and a resident unit 1220. The coaxial cable switch module 920 includes a switch 1210 and a termination 1225.

The controller 1215 may be connected to the building's LAN and may communicate over the network 115 with the portal 120 to issues commands to actuate the switch 1210 in the coaxial cable switch module 920. The controller may also stores the position of the switch 1210 in a memory. The controller 1215 may communicate with the switch 1210 using the backplane 915 of the multi-port coaxial cable switching device 900. One controller 1215 may be used for each coaxial cable switch module 920 or one controller may be used for numerous coaxial cable switch modules 920*a*-920*e*. In some embodiments, a coaxial cable switching device 900, which includes a controller 1215 may be a master, while a coaxial cable switching device 900, which does not includes controller 1215 is a slave. In some embodiments, up to two slaves can be controlled from one master. For example, by interconnecting three such devices, only one master is needed to control all of the switch modules in three chassis.

Each input port 1021*a*-1021*c* of the coaxial cable switch module 920 may be connected to a service 1230*a*-1230*c*, such as three different television providers. In this embodiment, three services 1230*a*-1230*c* are shown, but any number of services can be connected to the coaxial cable switch module 820 if the number of input ports 1021*a*-1021*c* is altered. The output port 1001 may be connected to a resident unit 1220 through a long-distance connection. The input ports 1021*a*-1021*c* and output port 1001 connect to a solid-state switch 1210 located within the coaxial cable switch module 920. The switch 1210 may be controlled by a GPIO expander and may be capable of connecting the output port 1101 to one of the input ports 1021*a*-1021*c* or to a termination 1225. The termination 1225 has a value of impedance appropriate to the cable system being used.

A number of switches 1210, sufficient to provide one output port for each resident unit, may be deployed in the building 105. The switches 1210 may then be used to connect and disconnect all of the resident units to and from one or more services. When a unit's coaxial cable switch modules 920*a*-920*e* connects one of the input ports 1021*a*-1021*c* to the output port 1101, the resident unit 1220 connected to the output port 1101 may be connected to service. When the unit's coaxial cable switch modules 920*a*-920*e* connects the output port 1101 to a termination 1225 instead of an input port 1021*a*-1021*c*, the resident unit 1220 may be disconnected from the service 1230*a*-1230*c*. In some embodiments, each input port 1021*a*-1021*c* may be physically capped off when not in use. In some embodiments, LEDs may indicate if the switch may be connected to the termination 1225 or a service 1230*a*-1230*b*.

In some embodiments, the coaxial cable switch module 920 includes a horizontal PCB and a vertical PCB. The horizontal PCB controls power, display, and master-slave communication. The horizontal PCB may have multiple power features including POE connection, auxiliary input, and battery backup. The vertical PCB contains all the unit-level switches which select the input and monitors for a switch 1210 failure. The vertical PCB may have any number of inputs. The horizontal PCB and vertical PCB design allows for onsite servicing because the vertical board and horizontal board can be easily replaced. In some embodiments, the switch 1210 includes individual unit switch failure monitoring. An RF monitor may be built into the vertical board that monitors the output signal to the resident unit 1220. If an RF signal may be discovered but the smart building system 100 indicates that the service is off, meaning the resident unit 1220 is receiving a service when the resident unit 1220 should not have a service, then an alert may be generated to inform technical support of a possible switch failure. In some embodiments, the coaxial cable switch module 920 may be replaced with the vertical PCB and may include any number of inputs. One vertical PCB may have any number of switches 1210 to control the provision of services to one or multiple resident units 1220.

Figure 13:
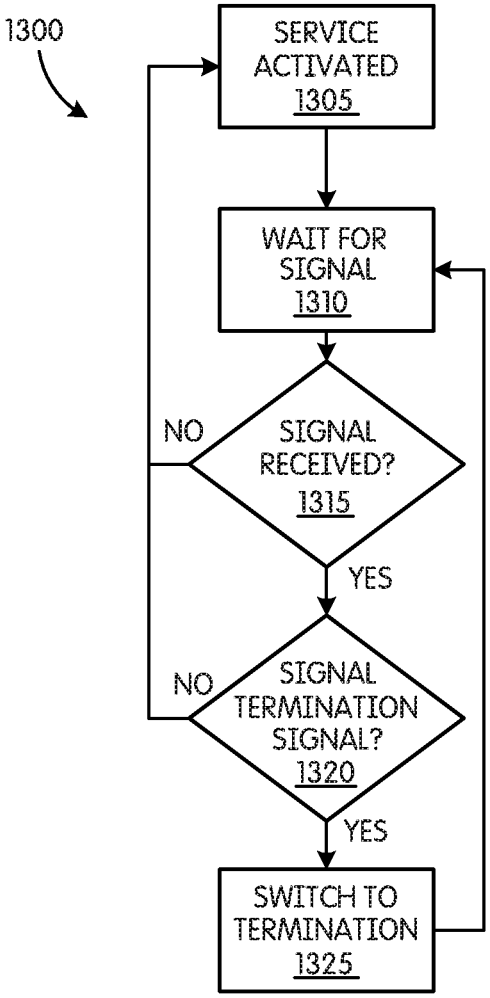
FIG. 13 is a flow chart for the switch connections of the coaxial cable switch module of FIG. 9-FIG. 12 according to some embodiments.

FIG. 13 is a flow chart for the switch 1310 connections of the coaxial cable switch module 920. The actuation of the switch 1310 may be controlled by the controller 1215 to provision services, such as cable television, within a building 105. At step 1305, a service is activated. Building owners may manually enable cable television service using the portal 120, or residents may order and pay for cable television service through the portal 120. The service may be automatically provisioned by the controller 1215 when ordered and paid for by the resident by sending a command to the switch 1210 to connect the output port 1101 to the designated service 1230*a*-1230*c*. At step 1310, the switch 1310 waits for a signal. If a signal is not received, the switch 1210 continues to operate in a service activated state at step 1305. If the switch 1310 receives a signal from the controller 1215, then the process continues to step 1320. If the signal is not a termination signal then the switch 1310 continues to operate in a service activated state at step 1305. If the signal is a termination signal, then the process moves to step 1325 where the switch 1310 connects the output port 1101 to the termination 1225. When the resident's output port 1101 is connected to the termination, the resident may no longer receive the service.

By deploying and operating the switch 1310, a building owner may connect and disconnect resident units from bulk-purchased cable services without interacting with the service provider. For example, a building owner may pay a fee to a cable service provider for a given number of units. The building owner may include the cable television service in the resident's rent, or charge the resident separately for the cable television service. In the prior art, if a resident was not current on his payment to the building owner, the building owner may have to manually disconnect the service, or contact the cable television service provider to disable the resident's decoder box. Embodiments of the invention may automatically keep track of the payments through the portal 120, disconnect the cable service for non-payment, and automatically reconnect the service when the resident brings his or her account current.

In another embodiment, a building owner or an accounting system may control the provision of services based on a resident's lease performance including current ledger. Residents may sign a lease addendum which allows the owner to limit or interrupt services for a resident due to non-performance or non-payment. For example, if a high priority document is not signed within the given time prior, one of the services may be interrupted until the resident completes the required document. The lease addendum prepares both the resident and owner for these actions by providing a mutually agreed upon understanding of how the smart building system 100 works.

In alternate embodiments, the multi-port coaxial cable switching device 900 may be used for video or image messaging from the owner or for an advertisement. For example, video or images may be sent to residents regarding lease performance matters. An additional switch may be included to switch between the service and the image or message.

In some embodiments the multi-port coaxial cable switching device 900 may also be applied to other services such as internet. Internet access to residents may be provided via wired or wireless systems in resident units and public areas of the building or grounds. The central and local servers are able to communicate with routers, switches, and other equipment used to provide internet access within the MDU building. The servers enable or disable access for a resident unit or individual resident network devices. The servers also determine the parameters of the internet service, such as bandwidth, access time, total data usage allowed, and other parameters for each connection and control the internet access devices to keep the internet access within those parameters.

Internet service may be provisioned using the portal 120 and the multi-port coaxial cable switching device 900, Building owners may manually enable internet service using the portal 120, or residents may order and pay for internet service through the portal. The service may be automatically provisioned by the servers when ordered and paid for by the resident. Similarly, if the resident fails to pay the bill, the servers may shut off the internet service for that resident using the multi-port coaxial cable switching device 900. Residents may still access the local network and the portal, even if their internet access is disabled. The access enables residents to bring their accounts current and restore their service. In other embodiments, internet services may be controlled separately or in tandem with the multi-port coaxial cable switching device 900 by a radius server inside the building that grants and limits access and download speeds.

In another embodiment, the multi-port coaxial cable switching device 900 may be applied to VOIP. VOIP service may be provided to resident units through the internet connections to those units. The VOIP service may be run from a separate server, and may provide service through VOIP-to-analog adapters, VOIP handsets, or other means. VOIP service may be provisioned using the smart building system's portal 120. Building owners may manually enable VOIP service using the portal 120, or residents may order and pay for the service through the portal 120. The service may be automatically provisioned by the servers when ordered and paid for by the resident. Similarly, if the resident fails to pay the bill, the servers may shut off the VOIP service using the multi-port coaxial cable switching device 900. In another embodiment, the VOIP communication may be controlled separately or in tandem with the multi-port coaxial cable switching device 900 by an analog telephone adapter, the portal 120, and/or operational telephone company computers.

Figure 14:
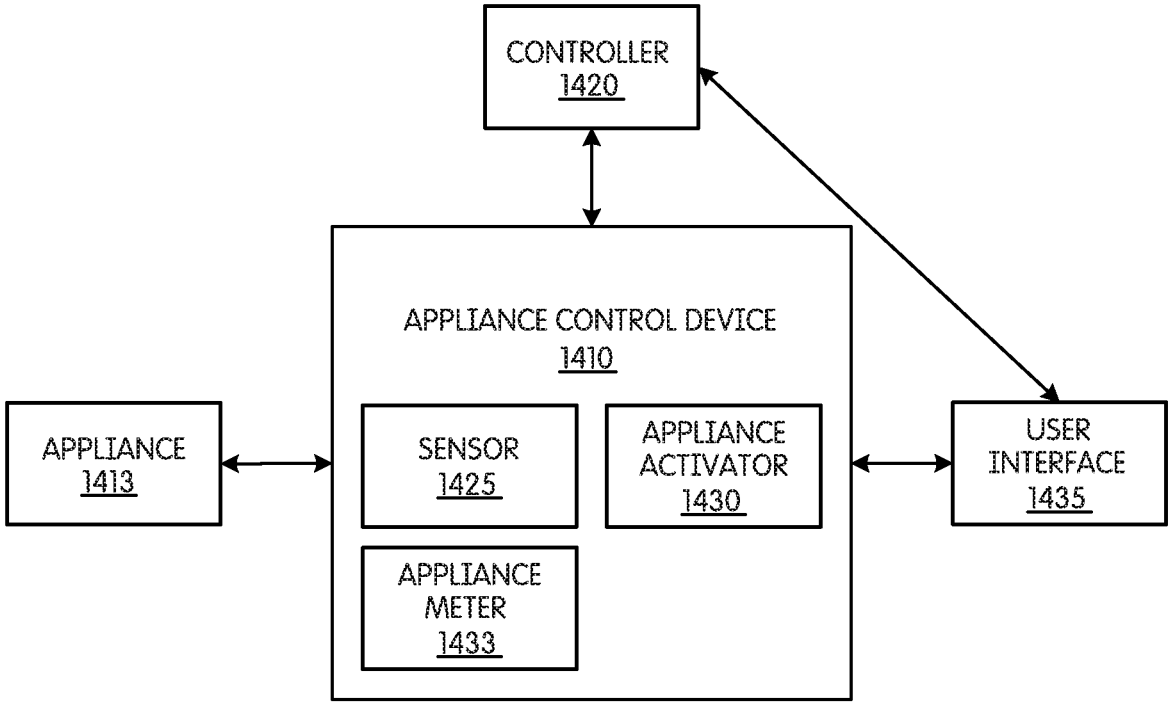
FIG. 14 is a block diagram of an appliance control device of the smart building system of FIG. 3 according to some embodiments.

FIG. 14 is a block diagram of an appliance control device 1410 of the smart building system 100 of FIG. 4 according to some embodiments of the present invention. The appliance control device 1410 controls and monitors the status (i.e., in use, time remaining, offline, reserved) of at least one appliance. The appliance control device 1410 includes at least one sensor 1425, an appliance meter 1433, and an appliance activator 1430. The appliance control device 1410 may be communicatively coupled to an appliance 1413, a controller 1420 and a user interface 1435. In some embodiments, the appliance control device 1410 may be used in reference to a laundry machine, but in other embodiments, the appliance control device 1410 may control another appliance 1413 such as a refrigerator or dishwasher. In some embodiments, the appliance control device 1410 may be connected to each individual appliance. In other embodiments, the appliance control device 1410 may be connected to multiple appliances. The components may be integrated into a single device, or may be grouped in different arrangements. The appliance control device 1410 may also be a stand-alone system.

The sensor 1425 detects the status of an appliance 1413. In some embodiments, the status may be detected by sensing the appliance's "in use" light, for example, in a washer or dryer. The sensor 1425 may also detect the progress of an appliance 1413 in a cycle, such as the amount of time until a laundry cycle is complete. In some embodiments, the progress of an appliance 1413 may be displayed through the portal 120 on the user-interface 200 so that a resident can see the status of the appliance 1413, such as the amount of time until a laundry machine completes a cycle.

The appliance meter 1433 measures parameters such as water, gas, and electricity usage for an appliance 1413, all of the appliances in a group (e.g, all laundry machines), or both. The measured parameter may be displayed on the user-interface 200 through the portal 120. For example, a baseline for utility usage of each appliance 1413 or each room with numerous appliances 1413 may be established. If the utility usage varies beyond the baseline by a predetermined amount, the smart building system 100 may alert the building owner or manager. The appliance meter 1433 also allows the building owner to see the costs and revenues for individual appliances 1413 or rooms containing multiple appliances 1413. In another example, appliance 1413 costs could be adjusted through the portal 120 to incentivize residents to use the appliance 1413 when utility costs are lower, or when the facilities are less busy.

The appliance activator 1430 is capable of activating the cycles of an appliance 1413 using suitable electro-mechanical means, such as relays, solenoids, motors, and linkages. The appliance activator 1430 may activate two states, such as on state or off state for an appliance 1413 or may activate numerous states for an appliance 1413 such as a wash state, rinse state, and spin state for a laundry machine.

The appliance control device 1410 may be communicatively coupled to the controller 1420. In some embodiments, the controller 1420 may be a single-board computer, though other embodiments may use other types of controllers. The controller 1420 may be connected to the building's LAN and configurable to communicate with the smart building system's servers. The controller 1420 may be connected to, and communicates with, the user interface 1435, the appliance activator 1430, and the at least one sensor 1425. The controller 1420 may be configurable to process credit or debit or other payment cards, or to take payments using a payment gateway such as through the portal 120. The controller 1420 may be configurable to control each appliance 1413 using the user interface 1435, the appliance activator 1430, and the at least one sensor 1425.

The appliance control device 1410 may also be communicatively coupled to a user interface 1435. The user interface 1435 may be a controller, a touch screen, a magnetic card reader, an RFID reader, or another type of interface. In some embodiments, the user interface 1435 may display the current date and time along with the time remaining in a cycle for an appliance. In some embodiments, the user interface may be used to pay for the services of an appliance.

Figure 15:
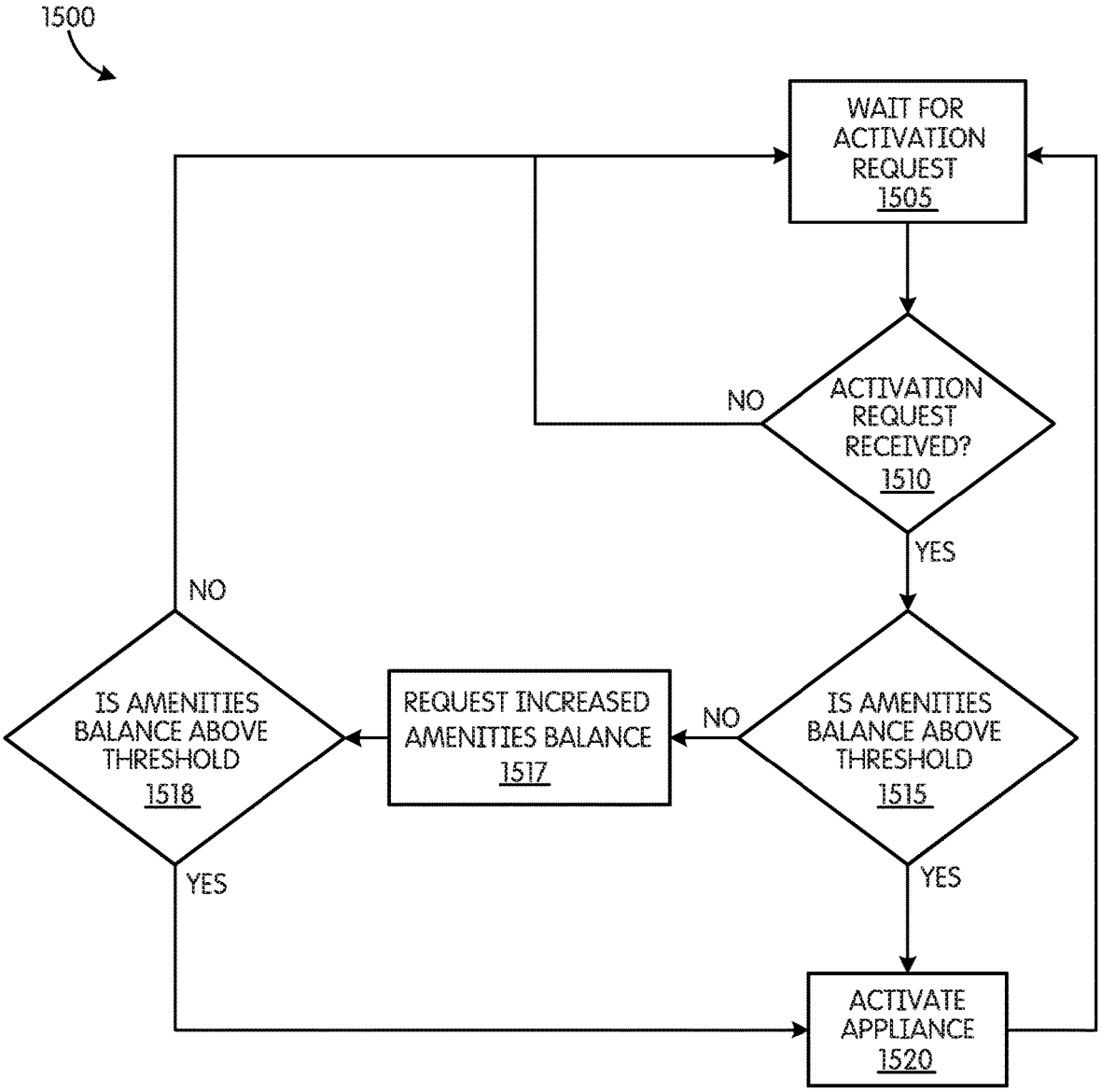
FIG. 15 is a flow chart for the appliance control device of FIG. 14 according to some embodiments.

FIG. 15 is a flow chart illustrating a method 1500 for controlling the appliance control device 1410 of FIG. 14. The method 1500 begins at step 1505 where the appliance control device 1410 waits for an activation request. At step 1510, if an activation request is not received, the appliance control device 1410 continues to wait for an activation request at step 1505. A resident wishing to do laundry may activate an appliance 1413 using a user interface 1435 such as a fob or by using a touch screen and entering a code. If at step 1510, an activation request is received, the appliance control device 1410 continues to step 1515. At step 1515, the controller 1420 checks the user's amenities balance. The controller 1420 accesses the portal 120 to find the current amenities balance. In some embodiments, the amenities balance may be a specific balance for an amenity such as a laundry amenities balance. If the amenities balance is above the threshold, meaning sufficient funds are available to pay for the appliance service, the appliance 1413 is activated using the appliance activator 1430 at step 1520. If the amenities balance is below the threshold, sufficient funds are not available, and the controller 1420 informs the resident through a user interface such as touch screen. The controller 1420 requests payment at step 1517, which the resident may provide using either a "single click" method via default payment source on the resident portal (auto log in w/touch of the fob) or a new credit card swipe using the credit card reader (the payment mechanism). If the amenities balance is increased above the threshold at step 1518 then the appliance 1413 is activated at step 1520. If the amenities balance remains below the threshold, then appliance control device 1410 returns to step 1505 to wait for an activation request.

In another embodiment of the invention, a guest may request the use of the laundry machine by using the touch screen, a FOB, or a Bluetooth enabled phone, and paying through the payment mechanism through the controller 1420 and user interface 1435. In some embodiments, the controller may be configured to require a two-part authentication to accept payments (e.g., a RFID fob and a PIN code entered by the resident).

In some embodiments of the invention, when a user touches their FOB to the reader of the user interface 1435, the controller 1420 may send a request to an onsite server which may then communicate with the portal 120 to lookup the laundry a balance of the user who used the FOB. If the balance is high enough, then the controller 1402 may display a message asking to have the user use their FOB again to confirm. After the user uses their FOB a second time, the controller may start the appliance and update the portal database with information about the event. If the balance is not high enough, and the user has a default payment method defined (i.e., credit card), then a message stating that a charge may be made to add to the balance may be displayed on the user interface 1435. If the user uses their FOB again, then the user's payment method may be assessed and the controller 1420 may start the appliance and update the portal 120 with information about the event. The onsite server may determine if the portal 120 is accessible. If the internet is down and the portal 120 is not accessible, then the information from a local copy of the database may be used to log the changes. After the portal 120 becomes accessible again, the changes may be applied to the portal 120 database.

In another embodiment, a user may start an appliance with a credit card if the internet is working. The controller 1420 may take the swipe from the credit card using the user interface 1435 through an encrypted VPN that may communicate with the portal 120 which uses a payment gateway to process the credit card. The display on the user interface 1435 may then show the name on the credit card and ask for a second swipe to confirm the transaction. When the second swipe is completed, the payment gateway may complete the sale to the credit card. If the credit card is used to replenish an account, then a one-time password is used via SMS. The user must reply to the SMS for the transaction to be completed. If the second swipe is not completed after thirty seconds, then the smart building system 100 may automatically void the credit card.

In some embodiments, controller 1420 communicates the state of its appliance 1413 to the portal 120, which may provide a status for each appliance 1413 to users of the portal 120. A resident may access the portal 120 to check for available appliances 1413 before going to the location of the appliance 1413. The resident may also reserve an appliance 1413 for a short time, or request to receive an electronic alert via email, SMS, or other means when an appliance 1413 is available. In one example, a resident, who wants to do laundry, accesses the portal 120 and discovers that all of the machines are busy. The resident then requests a washing machine. Thirty minutes later, a washing machine finishes its cycle. The controller 1420 tells that machine's appliance control device 1410 to block access to the machine for a pre-determined period of time, and sends a text message to the resident's cell phone. The resident brings his laundry to the laundry room within the pre-determined period of time, and activates the reserved machine's controller with his FOB.

In another embodiment of the invention, physical solenoids may be installed in the appliance control device 1410. Such solenoids may trigger mechanical motion to simulate pushing coins and may result in turning on a coiled timer.

In some embodiments of the invention, the appliance control device 1410 may be communicatively coupled to an interface board for easy installation. The interface board may be a second PCB that may grant control access to the appliance as well as monitor the in-use lights to signal the controller the status of the appliance.

Figure 16:
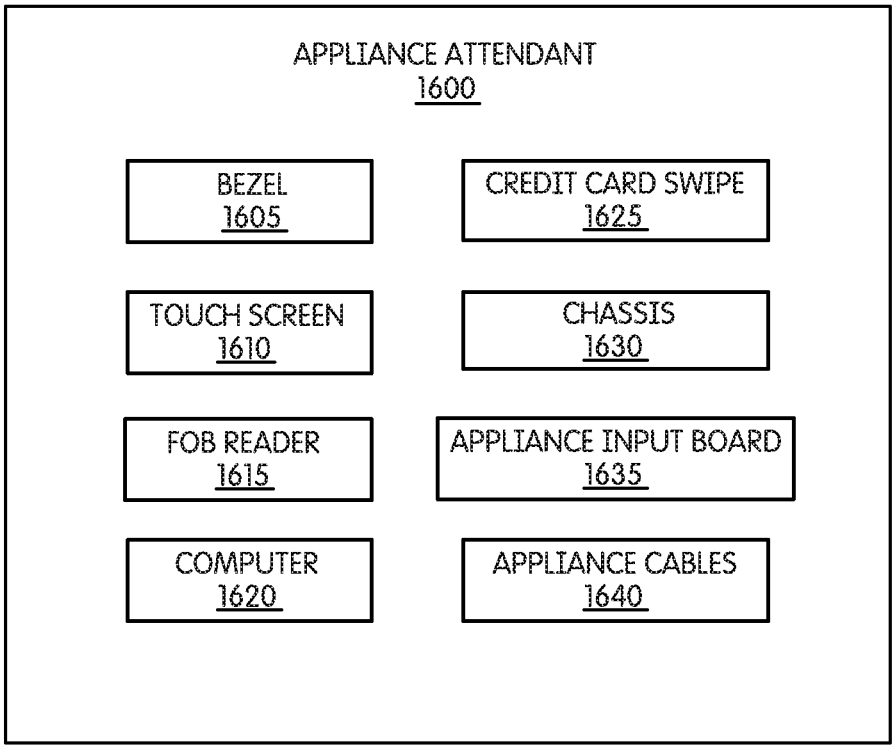
FIG. 16 is a block diagram of an appliance attendant according to some embodiments.

In another embodiment of the invention, the appliance control device 1410 may be communicatively coupled to an appliance attendant 1600 as shown in FIG. 16. The appliance attendant discovers appliances automatically and sets up a configuration with colocation. In some embodiments, the colocation may be a server in a data center that is connected to the cloud or another network. All user portals may reside on the server in the data center. The appliance attendant 1600 may be an independent controller that connects to the interface board for all aspects of an appliance and will work without a controller and onsite server. The appliance attendant 1600 can manage numerous appliances at once. The appliance attendant 1600 may include a bezel 1605, touch screen 1610, FOB reader 1615, computer 1620, credit card swipe 1625, chassis 1630, appliance input board 1635, and appliance cables 1640. The bezel 1605 may be made out of rugged cast aluminum, making it dust and water resistant. The appliance attendant 1600 accepts both POE and 5V power so that if the POE fails, the appliance attendant 1600 may still communicate with appliances. In some embodiments, the appliance attendant 1600 may be assembled using security screws for impact resistance and a ⅛th inch clear sheet to protect the screen. When installing the appliance attendant 1600, the contractor may press a button to test proper set up of each appliance and ensure full communication with the colocation. An appliance attendant 1600 may control one appliance or many appliances at once. In some embodiments, the appliance controller may manage up to 8 local appliances but it can also add 20 remote appliances for a total of 28 appliances.

In some embodiments, the appliance attendant 1600 may perform a number of different function regarding the appliance and user. The functions may include capturing images of a user during each transaction, providing security against fraud. Additionally, the appliance attendant 1600 may record transactions in duplicates for both credit cards and the portal 120 using different transaction numbers for easy problem solving and solution triangulation. The appliance attendant 1600 may take user input and interact with the portal 120 such as checking and implementing payments. A user may access their account on the portal 120 to view all transactions in the last month. A user may also make a reservation of an unused appliance using the appliance attendant 1600. A touch screen 1610 may display that an appliance is reserved. Unused reservations may incur a charge, and an appliance may be released from the reservation if it is not redeemed in a certain time period. Additionally, when a user is using an appliance, the appliance attendant 1600 may send a courtesy message, such as an SMS when a cycle is about to finish. The appliance attendant may also be used to communicate with the appliance meter 1433 to provide an owner or manager with real time profit or loss due to utility expenses.

Figure 17:
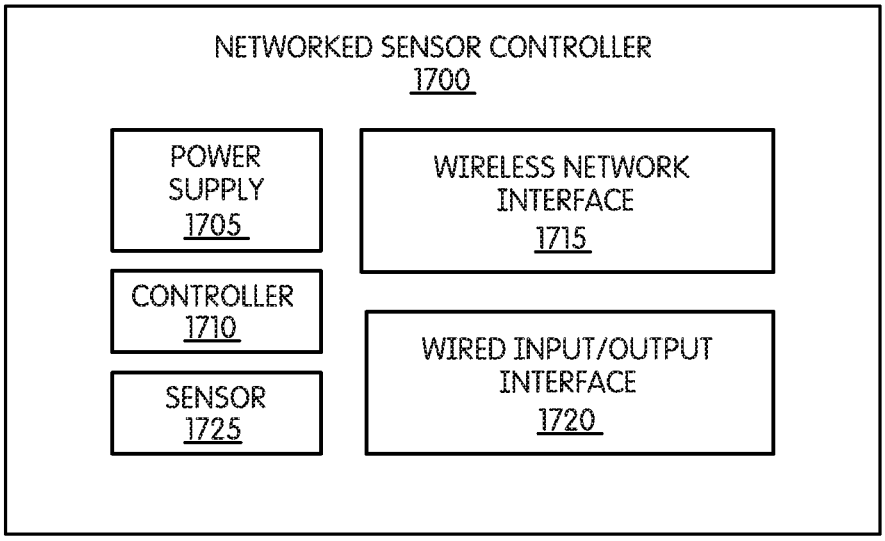
FIG. 17 is a block diagram of a networked sensor controller for a utility management tool according to some embodiments.

FIG. 17 is a block diagram of an embodiment of a networked sensor controller 1700 for a utility management tool. Utility management tools are used to provision utilities, and manage costs. Utility management systems include sensors and control systems to detect and regulate water usage, natural gas usage, electrical usage, and temperature in resident units and public areas of the building. Networked sensor controller 1700 may be deployed in residential units or in public areas as part of the utility management system. The networked sensor controller 1700 includes a power supply 1705, a controller 1710, a wireless network interface 1715, a wired input/output interface 1720, and one or more sensors 1725.

The power supply 1505 powers the components (i.e, controller 1710, sensor 1725, etc.) of the networked sensor controller 1500, and, in some embodiments, provides a battery backup. The power supply 1705 may be hard-wired to the building's electricity supply, or it may plug into a standard wall outlet. In some embodiments, the networked sensor controller 1700 receives power from a power over Ethernet (PoE) system.

In some embodiments, the controller 1710 may be a single-board computer running an embedded UNIX-variant operating system (e.g., raspberry Pi). In other embodiments, the controller 1710 may be a central processing unit (CPU) based device with a memory. The wireless network interface operates using Wi-Fi, or another suitable wireless networking protocol, and may be capable of connecting the controller 1710 to the MDU building's LAN or other devices. The controller 1710 may be configurable to receive inputs from, and provide output to, remote sensors, switches, or other devices using the wired input/output interface 1720.

The sensors 1725 are capable of detecting temperature, smoke, carbon monoxide, motion, moisture, and other characteristics of the area in which the sensors 1725 are deployed. The controller 1710, wireless network interface 1715, a wired input/output interface 1720, and sensors 1725 are contained in a single housing, which may be mounted in a central location suitable for the area being sensed. The housing may be configured with air holes, filters, and other means to allow the sensors 1725 to accurately detect the surrounding environment. The sensors 1725 and the controller 1710 are configured to minimize the effects from the controller 1710 components or the housing on the sensor readings. In some embodiments, other sensors, which are external to the networked sensor controller 1700, are connected to the networked sensor controller 1500. Some sensors may be connected wirelessly, and others are connected via the wired input/output interface 1720. External sensors may include glass breakage sensors, motion sensors, temperature sensors, and other environmental and security sensors.

The networked sensor controllers 1700, among other things, record usage of utilities and communicate usage to the servers and portal 120. The servers use the recorded usage of utilities to provide data to the building owner, issues alerts, and/or adjust the provisioning of the utilities based on certain parameters. In one example, a common area of the building, such as a stairwell, may have windows with leaky seals. If the stairwell is infrequently used, building management may not discover the leaky seals. However, if the smart building system 100 detects that the stairwell is consistently too cold in the winter, it may alert building management of the temperature. The alert enables the building management to investigate and remedy the cause of the colder temperature by fixing the leaky window seals.

In another example, a MDU building might contain a utility system for including utilities in the rent. The utility system may detect if residents are using more than their fair share of the utilities, and adjust the utilities. For instance, if a resident unit maintains a high temperature for more than a specified number of days in a month, the heat to that unit could be adjusted, in compliance with applicable laws, to keep that resident from using too much of the building's resources. Similarly, water usage could be regulated to prevent a unit from using too much water. For example, a leaking toilet tank or other water leak may be identified by creating a baseline with "water shut off" and comparing it to a second baseline with water usage "middle of the night". If usage in the middle of the night exceeds the expected usage then a "possible leak" exception alert may be sent to the manager.

Figure 18:
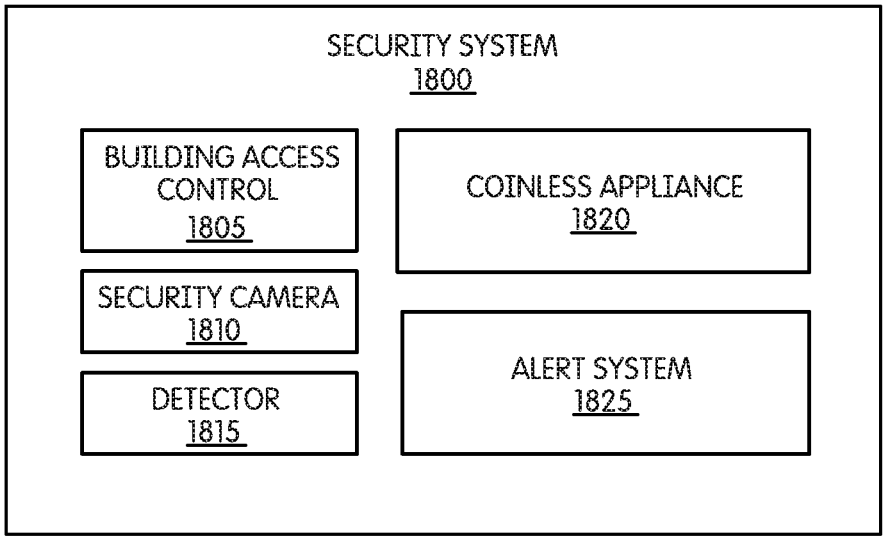
FIG. 18 is a security system according to one embodiment of the invention according to some embodiments.

FIG. 18 illustrates a security system 1800 according to one embodiment of the invention. Security system 1800 include a building access control 1805, a security camera 1810 for monitoring, at least one detector 1814 for fire, smoke, a hazardous substance, such as carbon monoxide, or an intrusion. The security system 1800 also may include coinless appliances 1820 which discourage vandalism and an alert system 1825. In the event a hazardous condition is detected, the smart building system 100 may be configured to notify all relevant users immediately using the alert system 1825. In one example, a carbon monoxide or fire alarm is triggered, and the smart building system 100 alerts the local authorities, and sends an electronic alert to the building's owner(s), manager(s), and residents.

Some embodiments of the invention may include an Instant Safe™ feature. With Instant Safe™, a user, such as an owner or manager may receive an alert. The alert may be any alert such as but not limited to, a door break-in or vandalism alert. The alert may be sent through the portal 120 to a phone or other user-interface in the form of an email, SMS, or other type of message. The alert message may include a link. When the user clicks the link, the user-interface may stream video and audio at the location that the alert originated so that the user may view the area. For example, if an alert is sent due to an attempted break-in, the link in the message will stream video and audio of the door where a person is attempting to break-in. In some embodiments, the alert may include an emergency SMS broadcast to all building residents.

Figure 19:
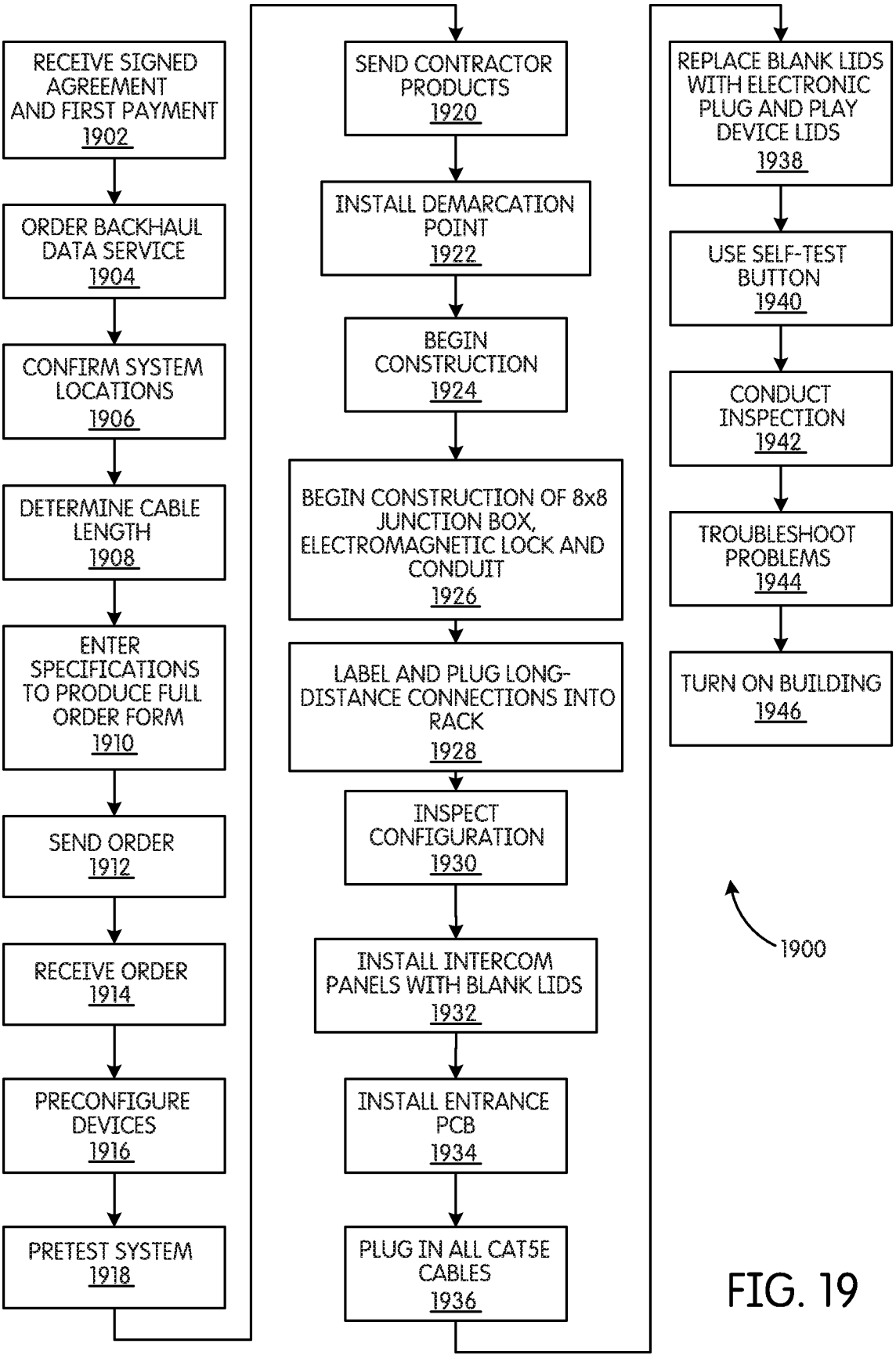
FIG. 19 is a flow chart illustrating a method for converting a legacy system into a smart building system according to some embodiments.

FIG. 19 is a flow chart illustrating an exemplary method 1900 for converting a legacy system into a smart building system 100. FIG. 19 illustrates one embodiment of the invention and the steps may be performed in a different order or with additional or less steps in another embodiment of the invention. The process begins at step 1902 where a signed agreement and first payment are received for installing a smart building system 100. Once the signed agreement and first payment are received, the backhaul data service is ordered for the location that the smart building system 100 is going to be installed at step 1904. In some embodiments, the backhaul data service may be a specifically filtered version of the internet for specific users. Next, the site location where the smart building system 100 is going to be installed is visited to confirm all of the individual system locations at step 1906. The visit includes confirming the position of door swings, cameras, and riser and corridor hallways and pathways for cables. At step 1908, the length for the 10 Category 5 enhanced (Cat-5e) (or similar data cable) cable colors is determined using google earth or another similar program. Then at step 1910, the specifications for the smart building system 100 are entered into a smart building system program to produce a full order form including the items and the suppliers. At step 1912, the order is sent. The order includes the predetermined cable lengths as determined by the smart building system program.

At step 1914, the order is received by technical support with a purchase order (PO) specifically for a given building. In some embodiments, the PO includes only the items that are needed for a specific project. Next at step 1916, technical support preconfigures the devices, updates the firmware and performs tests. All devices may be plug and play devices and are delivered with inputs (e.g., jacks). At step 1918, the entire smart building system 100 is pretested before installation.

At step 1920, the contractor purchases his or her own conduit and receives a set of boxes. For a 50 unit building, the contractor receives 10 boxes. Each box contains all the products needed for a given entrance. The products include color coded cables and preprinted templates to drill holes. At step 1922, the contractor installs the demarcation point which includes 24V power, a rack with the patch panel, trough and double independent circuits for redundant backhaul data services. In some embodiments, the rack may be mounted on a wall that has a panel on it. Behind the panel the wires for the building may terminate. On the front of the panel there may be patch cables that connect to specific ports and the main controller 410. At step 1924, construction of the smart building system 100 begins. At step 1926, all of the 8×8 junction boxes, electromagnetic locks and conduits in all locations where cables are visible to the public are installed. Corrugated uniduct conduits are installed in the basement and non-public locations. At step 1928, a predetermined wiring guide is used to label and plug long-distance connections into the rack. In some embodiments, the rack and patch panels only contain female jacks because no punchdown wiring is needed for cat5e.

At step 1930, the project manager inspects the installation and confirms if the deadline for install will be met. Once step 1930 is completed, the intercom panels with device housing boxes are installed at step 1932. The intercom panels are installed using blank lids for the readers, the names display, the digital intercom, and the appliance control devices. In some embodiments, the contractor will install the appliance attendant followed by the appliance control device and the interface board.

Once the hardware is installed, the contractor installs the entrance PCB and plugs in all cat5e cables at step 1934. The entrance PCB only receives pre-terminated RJ 45 plugs from the pre-terminated cables that the contractor received. Each port is labeled and corresponds with the proper cable color. In some embodiments, if a contractor needs to cut off any leads while on a ladder, the contractor may use a designated website containing all of the specifications and pin out positions for each device. At step 1938, the contractor replaces all of the blank lids with electronic plug and play device lids. At step 1940, the contractor uses a self-test button on the entrance PCB that initiates a call to the portal 120 for authentication. Red and green light emitting diodes (LED)s inform the contractor if any of the subsystems or devices of the smart building system 100 require attention.

In some embodiments, the contractor may press a button that initiates a protocol sequence to find and build the necessary communication pathways with the portal 120, appliance control device 1410, and appliance attendant 1600. A progress bar may be provided on both the appliance control device 1410 and the appliance attendant 1600. Once communication is made successfully, a final message is displayed filing the contractor permission to close the appliance. Otherwise, technical support must be notified to troubleshoot the problem.

At step 1942, an inspection is conducted and contractors, while on ladders, are able to view camera footage via a web link so that the contractors can focus and direct the cameras as needed. At step 1944, technical support comes to the building 105 site to test and troubleshoot the building when the smart building system 100 is turned on. At step 1946, the smart building system 100 is turned on.

These steps allow for easy and efficient installation of the smart building system 100 into a preexisting building. These steps reduce cost and increase profit for the building 105 owner.

In the foregoing specification, specific embodiments have been described. However, one of ordinary skill in the art appreciates that various modifications and changes may be made without departing from the scope of the invention. Accordingly, the specification and figures are to be regarded in an illustrative rather than a restrictive sense, and all such modifications are intended to be included within the scope of present teachings. Thus, the invention provides, among other things, a smart building installation method and automation system for MDU buildings 105*a*-105*c* that provides a user-friendly experience.

What is claimed is:

1. A method for converting a legacy building into a smart building, the method comprising:

calculating a distance between a first connection point and a second connection point;

creating a cable having a first length based on the distance between the first connection point and the second connection point;

installing a demarcation point;

converting a plurality of legacy systems into controllable smart systems, each of the controllable smart systems configured to manipulate legacy system signals into digital signals;

connecting the demarcation point and at least one of the plurality of legacy systems using the cable, to create a smart building system configured to control the plurality of legacy systems;

connecting the smart building system to an interactive online portal, the interactive online portal located external to the smart building and configured to configure and control the smart building system; and testing the connection of the smart building system to the interactive online portal, wherein testing the connection includes initiating a call, via one or more computer networks, to the interactive online portal for authentication.

2. The method of claim 1, wherein installing the demarcation point includes connecting a demarcation device to an existing system of the building.

3. The method of claim 1, wherein installing the smart building system includes installing each of the plurality of legacy systems with a blank lid.

4. The method of claim 1, wherein the plurality of legacy systems may include at least one selected from the group consisting of an entrance system, an appliance system, a security system, and a services system.

* * * * *